US009983520B2

(12) United States Patent
Tabata et al.

(10) Patent No.: US 9,983,520 B2
(45) Date of Patent: May 29, 2018

(54) TRANSFER BELT AND IMAGE FORMING APPARATUS

(71) Applicant: KONICA MINOLTA, INC., Chiyoda-ku, Tokyo (JP)

(72) Inventors: Eiji Tabata, Ibaraki (JP); Nofumi Mizumoto, Nara (JP); Toshiya Natsuhara, Takarazuka (JP); Shigeo Uetake, Takatsuki (JP); Keiko Momotani, Ibaraki (JP); Makiko Watanabe, Uji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/634,712

(22) Filed: Jun. 27, 2017

(65) Prior Publication Data

US 2018/0011428 A1 Jan. 11, 2018

(30) Foreign Application Priority Data

Jul. 5, 2016 (JP) ..... 2016-133310

(51) Int. Cl.
*G03G 15/16* (2006.01)

(52) U.S. Cl.
CPC ..... *G03G 15/169* (2013.01); *G03G 15/162* (2013.01)

(58) Field of Classification Search
CPC . G03G 15/162; G03G 15/1685; G03G 15/169
USPC ..... 399/302, 303, 308, 313
See application file for complete search history.

(56) References Cited

U.S. PATENT DOCUMENTS

2013/0011151 A1* 1/2013 Watanabe ..... G03G 15/161 399/302
2014/0334847 A1* 11/2014 Takahashi ..... G03G 15/1605 399/313

FOREIGN PATENT DOCUMENTS

JP 2014085633 A 5/2014
JP 2014102384 A 6/2014

* cited by examiner

*Primary Examiner* — Sophia S Chen
(74) *Attorney, Agent, or Firm* — Holtz, Holtz & Volek PC

(57) ABSTRACT

A transfer belt is configured to transfer a toner image carried on a first main surface of the transfer belt to a recording medium. When the transfer belt is pressed with pressure application three increased at a predetermined pressure application rate and is then pressed with certain pressure application force by using a lower block provided with a hole and an upper block, k2 [μm/s] satisfies 6≤k2≤30, k2 [μm/s] being determined by (a−b)/{2×(t2−t1)}, where a [μm/s] represents a maximum value of a displacement amount of a measurement region that is a portion of the first main surface corresponding to the hole, b [μm] represents a convergence value thereof, t1 [s] represents a time when the maximum value is observed, and t2 [s] represents a time when the displacement amount reaches (a+b)/2 again after the maximum value is observed.

7 Claims, 13 Drawing Sheets

FIG.16

| | BELT TYPE | EVALUATION RESULT BY DISPLACEMENT AMOUNT MEASURING DEVICE | | | | | IMAGE FORMATION CONDITION | | IMAGE FORMATION RESULT | | | | COMPREHENSIVE EVALUATION |
|---|---|---|---|---|---|---|---|---|---|---|---|---|---|
| | | a [μm] | b [μm] | E [-] | k1 [μm/s] | k2 [μm/s] | TRANSFER PRESSURE [kPa] | DIAMETER OF SECONDARY TRANSFER ROLLER [mm] | TRANSFERABILITY | IMAGE NOISE | UNIFORMITY IN AXIAL DIRECTION | VOID | |
| EXPERIMENT EXAMPLE1 | A | 10.0 | 5.0 | 1.00 | 180 | 15.0 | 200 | 40 | GOOD | GOOD | GOOD | GOOD | EXCELLENT |
| EXPERIMENT EXAMPLE2 | B | 6.0 | 5.0 | 0.20 | 60 | 6.0 | 200 | 40 | GOOD | GOOD | GOOD | GOOD | EXCELLENT |
| EXPERIMENT EXAMPLE3 | C | 20.0 | 5.0 | 3.00 | 320 | 30.0 | 200 | 40 | GOOD | GOOD | GOOD | GOOD | EXCELLENT |
| EXPERIMENT EXAMPLE4 | D | 8.0 | 4.0 | 1.00 | 180 | 15.0 | 200 | 40 | GOOD | GOOD | GOOD | GOOD | EXCELLENT |
| EXPERIMENT EXAMPLE5 | O | 16.0 | 8.0 | 1.00 | 180 | 15.0 | 200 | 40 | GOOD | GOOD | GOOD | GOOD | EXCELLENT |
| EXPERIMENT EXAMPLE6 | A | 10.0 | 5.0 | 1.00 | 180 | 15.0 | 100 | 40 | GOOD | GOOD | GOOD | GOOD | EXCELLENT |
| EXPERIMENT EXAMPLE7 | A | 10.0 | 5.0 | 1.00 | 180 | 15.0 | 400 | 40 | GOOD | GOOD | GOOD | GOOD | EXCELLENT |
| EXPERIMENT EXAMPLE8 | A | 10.0 | 5.0 | 1.00 | 180 | 15.0 | 200 | 20 | GOOD | GOOD | GOOD | GOOD | EXCELLENT |
| EXPERIMENT EXAMPLE9 | A | 10.0 | 5.0 | 1.00 | 180 | 15.0 | 200 | 60 | GOOD | GOOD | GOOD | GOOD | EXCELLENT |
| EXPERIMENT EXAMPLE10 | A | 10.0 | 5.0 | 1.00 | 180 | 15.0 | 70 | 40 | GOOD | GOOD | APPLICABLE | GOOD | GOOD |
| EXPERIMENT EXAMPLE11 | A | 10.0 | 5.0 | 1.00 | 180 | 15.0 | 500 | 40 | GOOD | GOOD | GOOD | APPLICABLE | GOOD |
| EXPERIMENT EXAMPLE12 | A | 10.0 | 5.0 | 1.00 | 180 | 15.0 | 200 | 16 | GOOD | GOOD | APPLICABLE | GOOD | GOOD |
| EXPERIMENT EXAMPLE13 | A | 10.0 | 5.0 | 1.00 | 180 | 15.0 | 200 | 70 | GOOD | GOOD | GOOD | APPLICABLE | GOOD |
| EXPERIMENT EXAMPLE14 | F | 5.8 | 5.0 | 0.15 | 50 | 5.0 | 200 | 40 | NON-APPLICABLE | GOOD | GOOD | GOOD | NON-APPLICABLE |
| EXPERIMENT EXAMPLE15 | G | 22.5 | 5.0 | 3.50 | 350 | 35.0 | 200 | 40 | GOOD | NON-APPLICABLE | GOOD | GOOD | NON-APPLICABLE |
| EXPERIMENT EXAMPLE16 | H | 7.0 | 3.5 | 1.00 | 180 | 15.0 | 200 | 40 | APPLICABLE | GOOD | GOOD | GOOD | APPLICABLE |
| EXPERIMENT EXAMPLE17 | I | 18.0 | 9.0 | 1.00 | 180 | 15.0 | 200 | 40 | GOOD | APPLICABLE | GOOD | GOOD | APPLICABLE |
| EXPERIMENT EXAMPLE18 | X | 5.0 | 4.4 | 0.14 | 40 | 4.5 | 200 | 40 | NON-APPLICABLE | GOOD | GOOD | GOOD | NON-APPLICABLE |

FIG.17

| | BELT TYPE | EVALUATION RESULT BY DISPLACEMENT AMOUNT MEASURING DEVICE | IMAGE FORMATION CONDITION | | IMAGE FORMATION RESULT | |
|---|---|---|---|---|---|---|
| | | k2[μm/s] | TRANSFER PRESSURE [kPa] | DIAMETER OF SECONDARY TRANSFER ROLLER [mm] | DETACHABILITY OF RECORDING MEDIUM | CLEANABILITY |
| EXPERIMENT EXAMPLE19 | J | 10.0 | 200 | 40 | GOOD | GOOD |
| EXPERIMENT EXAMPLE20 | K | 6.0 | 200 | 40 | APPLICABLE | APPLICABLE |
| EXPERIMENT EXAMPLE21 | L | 5.0 | 200 | 40 | APPLICABLE | APPLICABLE |
| EXPERIMENT EXAMPLE22 | M | 3.0 | 200 | 40 | NON-APPLICABLE | APPLICABLE |
| EXPERIMENT EXAMPLE23 | N | 1.0 | 200 | 40 | NON-APPLICABLE | NON-APPLICABLE |

TRANSFER BELT AND IMAGE FORMING APPARATUS

This application is based on Japanese Patent Application No. 2016-133310 filed with the Japan Patent Office on Jul. 5, 2016, the entire content of which is hereby incorporated by reference.

BACKGROUND OF THE INVENTION

Field of the Invention

The present invention relates to a transfer belt that transfers a carried toner image to a recording medium, and an image forming apparatus including the transfer belt. Particularly, the present invention relates to a transfer belt at least including an elastic layer, and an image forming apparatus including the transfer belt.

Description of the Related Art

Generally, in an image forming apparatus, a toner image formed on a surface of a photoconductor is transferred onto a surface of a transfer belt at a primary transfer portion, whereby the toner image is carried by the transfer belt. Then, the toner image thus carried by the transfer belt is transferred to a recording medium, such as a sheet, at a secondary transfer portion.

Normally, in the secondary transfer portion, a predetermined electric field is formed between a secondary transfer roller and a counter roller both constituting a nip portion. The electric field acts to cause the toner to move from the transfer belt, which passes through the nip portion, to the recording medium, which also passes through the nip portion. Accordingly, the toner image is transferred onto the recording medium at the secondary transfer portion.

For such a transfer belt, various types of transfer belts have been proposed. A transfer belt including an elastic layer has been known as a transfer belt allowing for transfer onto a recording medium (for example, embossed paper) having a recording surface provided with irregularity. For example, Japanese Laid-Open Patent Publication No. 2014-85633 or Japanese Laid-Open Patent Publication No. 2014-102384 discloses a transfer belt in which an elastic layer composed of an acrylic rubber or the like is provided on a base layer constituted of an inelastic layer composed of polyimide or the like.

Since the transfer belt having such an elastic layer is used, when the transfer belt is pressed against the recording medium at the nip portion of the secondary transfer portion, the transfer belt is deformed such that a portion of the front surface side of the transfer belt enters a recess provided in the surface of the recording medium. This leads to a reduced distance between the bottom surface of the recess of the recording medium and the front surface of the transfer belt. Accordingly, the action of the electric field is facilitated to promote the movement of the toner, thus attaining improved transferability to the recording medium having the recording surface provided with the irregularity.

Even when such a transfer belt having the above-described elastic layer is used, the elastic layer provided in the transfer belt needs to have an increased thickness and a decreased hardness in order to achieve high transferability to a recording medium having a surface provided with a deeper recess.

However, the transfer belt thus configured is cracked or worn at an early stage due to repeated use, thus resulting in significantly deteriorated image quality, disadvantageously.

SUMMARY OF THE INVENTION

In view of this, the present invention has been made to solve the above-described problem, and has an object to provide a transfer belt that can achieve high transferability to a recording medium having a surface provided with irregularity and that can suppress deterioration of image quality even in the case of repeated use, as well as an image forming apparatus including such a transfer belt.

As a result of conducting diligent research by producing various types of belts including elastic layers, the present inventors have found that transferability is drastically improved only when using, as a transfer belt, a belt having a surface deformed to exhibit a predetermined characteristic behavior when pressure is applied thereto under a predetermined pressure application condition. Accordingly, the present inventors have completed the present invention. Here, by using an evaluation method employing a below-described displacement amount measuring device contrived by the present inventors, it is possible to evaluate whether or not a belt has a surface deformed to exhibit a predetermined characteristic behavior when pressure is applied thereto under a predetermined pressure application condition.

A transfer belt according to the present invention at least includes an elastic layer, the transfer belt having a pair of exposed main surfaces constituted of a first main surface and a second main surface located opposite to each other, the transfer belt being for transferring a toner image carried on the first main surface to a recording medium, k2 [μm/s] satisfying $6 \leq k2 \leq 30$ when a pressed region of the transfer belt is pressed at a pressure application rate of 4 [kPa/ms] until pressure application force reaches 200 [kPa] and then is uniformly pressed under the pressure application force of 200 [kPa] by using a lower block that has an upper surface having a protrusively curved elongated surface having a width of 20 [mm] and a curvature radius of 20 [mm] and that is provided with a hole formed at a top of the protrusively curved elongated surface and having a diameter of 1.25 [mm] and an upper block that has a lower surface having a recessively curved elongated surface having a width of 20 [mm] and a curvature radius of 20.3 [mm] so as to place the transfer belt on the upper surface of the lower block such that the first main surface faces the upper surface of the lower block and so as to sandwich a portion of the transfer belt between the protrusively curved elongated surface and the recessively curved elongated surface by lowering the upper block toward the lower block, the pressed region of the transfer belt being the portion of the transfer belt sandwiched between the protrusively curved elongated surface and the recessively curved elongated surface, k2 [μm/s] being determined by $(a-b)/\{2\times(t2-t1)\}$, where a [μm] represents a maximum value of a displacement amount of a measurement region that is a portion of the first main surface corresponding to the hole, b [μm] represents the displacement amount of the measurement region after the displacement of the measurement region is converged, t1 [s] represents a period of time from a point of time at which the pressed region is started to be pressed to a point of time at which the maximum value of the displacement amount of the measurement region is observed, and t2 [s] represents a period of time from the point of time at which the pressed region is started to be pressed to a point of time at which the displacement amount of the measurement region reaches (a+b)/2 again after the maximum value of the displacement amount of the measurement region is observed.

Preferably in the transfer belt according to the present invention, b further satisfies $4 \leq b \leq 8$.

The transfer belt according to the present invention preferably further includes a base layer and a front layer in addition to the elastic layer. In that case, the first main surface is preferably defined by the front layer by providing the elastic layer to cover the base layer and providing the front layer to cover the elastic layer.

An image forming apparatus according to the present invention includes: an image carrier and an intermediate transfer belt that both carry a toner image; a primary transfer portion that transfers the toner image carried by the image carrier to the intermediate transfer belt; and a secondary transfer portion that transfers the toner image carried by the intermediate transfer belt to a recording medium. The secondary transfer portion includes a secondary transfer roller, a counter roller facing the secondary transfer roller, and a nip portion formed by the secondary transfer roller and the counter roller. The intermediate transfer belt is disposed to pass through the nip portion. In the image forming apparatus according to the present invention, the transfer belt according to the present invention is used as the intermediate transfer belt.

Preferably in the image forming apparatus according to the present invention, the first main surface of the intermediate transfer belt is disposed to face the secondary transfer roller. In that case, the secondary transfer roller preferably has a surface having a hardness higher than a hardness of a surface of the counter roller.

Preferably in the image forming apparatus according to the present invention, the secondary transfer roller has a diameter of not less than 20 [mm] and not more than 60 [mm].

Preferably in the image forming apparatus according to the present invention, a maximum pressure in the nip portion is not less than 100 [kPa] and not more than 400 [kPa].

The foregoing and other objects, features, aspects and advantages of the present invention will become more apparent from the following detailed description of the present invention when taken in conjunction with the accompanying drawings.

BRIEF DESCRIPTION OF THE DRAWINGS

Each of FIG. 3B

FIG. 16 is a table showing image formation conditions and image formation results in an experiment for checking performance.

FIG. 17 is a table showing image formation conditions and image formation results in an additional experiment.

DESCRIPTION OF THE PREFERRED EMBODIMENTS

Figure 1:
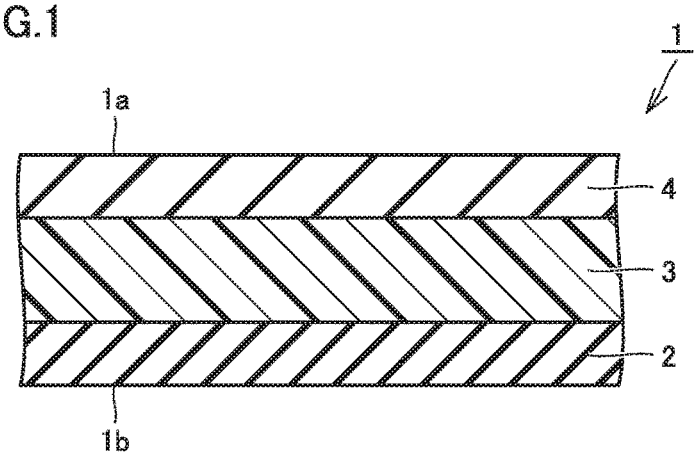
FIG. 1 is a cross sectional view of a transfer belt in an embodiment of the present invention.

The following describes embodiments of the present invention in detail with reference to figures. It should be noted that in the embodiments described below, the same or common portions are given the same reference characters in the figures and are not described repeatedly.

<Transfer Belt>

FIG. 1 is a cross sectional view of a transfer belt in an embodiment of the present invention. First, with reference to FIG. 1, a configuration of transfer belt 1 in the present embodiment will be described.

As shown in FIG. 1, transfer belt 1 is constituted of a member having a first main surface 1*a* and a second main surface 1*b*, which are a pair of exposed main surfaces located opposite to each other. Transfer belt 1 includes a base layer 2, an elastic layer 3, and a front layer 4.

Elastic layer 3 is provided to cover base layer 2, and front layer 4 is provided to cover elastic layer 3. Accordingly, first main surface 1*a* is defined by front layer 4, and second main surface 1*b* is defined by base layer 2.

For example, in an electrophotographic image forming apparatus or the like, transfer belt 1 serves to transfer a carried toner image onto a recording medium. The toner image is carried on first main surface 1*a*. It should be noted that a specific, exemplary manner of attaching transfer belt 1 to such an image forming apparatus will be described later.

Base layer 2 is a layer for improving mechanical strength of transfer belt 1 as a whole, and is constituted of a layer composed of an organic polymer compound, for example. Examples of the organic polymer compound of base layer 2 include: polycarbonate; a fluorine-based resin; styrene-based resins (homopolymer or copolymer including styrene or styrene substitute) such as polystyrene, chloropolystyrene, poly-α-methylstyrene, a styrene-butadiene copolymer, a styrene-vinyl chloride copolymer, a styrene-vinyl acetate copolymer, a styrene-maleate copolymer, styrene-acrylate ester copolymers (such as a styrene-methyl acrylate copolymer, a styrene-ethyl acrylate copolymer, a styrene-butyl acrylate copolymer, a styrene-octyl acrylate copolymer, and a styrene-phenyl acrylate copolymer), styrene-methacrylate ester copolymers (such as a styrene-methyl methacrylate copolymer, a styrene-ethyl methacrylate copolymer, and a styrene-phenyl methacrylate copolymer), a styrene-α-chloromethyl acrylate copolymer, and a styrene-acrylonitrile-acrylate ester copolymer; a methyl methacrylate resin; a butyl methacrylate resin; an ethyl acrylate resin; a butyl acrylate resin; modified acrylic resins (such as a silicone modified acrylic resin, a vinyl chloride modified acrylic resin, and an acrylic urethane resin); a vinyl chloride resin; a styrene-vinyl acetate copolymer; a vinyl chloride-vinyl acetate copolymer; a rosin modified maleic resin; a phenol resin; an epoxy resin; a polyester resin; a polyester polyurethane resin; polyethylene; polypropylene; polybutadiene; polyvinylidene chloride; an ionomer resin; a polyurethane resin; a silicone resin; a ketone resin; an ethylene-ethyl acrylate copolymer; a xylene resin and a polyvinyl butyral resin; a polyimide resin; a polyimide resin; a modified polyphenylene oxide resin; modified polycarbonate; a mixture thereof; and the like. It should be noted that base layer 2 may be constituted of a plurality of layers composed of different materials.

A conducting agent may be added to base layer 2 in order to adjust a resistance value. For this conducting agent, only one type of conducting agent may be added, or a plurality of types of conducting agents may be added. The content of the conducting agent in base layer 2 is preferably, but not limited to, not less than 0.1 part by weight and not more than 20 parts by weight with respect to 100 parts by weight of the base layer material.

Elastic layer 3 is a layer for providing elasticity to transfer belt 1, and is constituted of a layer composed of an organic compound that exhibits viscoelasticity, for example. Examples of the organic compound of elastic layer 3 include a butyl rubber, a fluorine-based rubber, an acrylic rubber, an ethylene propylene rubber (EPDM), a nitrile butadiene rubber (NBR), an acrylonitrile butadiene styrene rubber, a natural rubber, an isoprene rubber, a styrene-butadiene rubber, a butadiene rubber, an ethylene-propylene rubber, an ethylene-propylene terpolymer, a chloroprene rubber, chlorosulfonated polyethylene, chlorinated polyethylene, a urethane rubber, syndiotactic 1, 2-polybutadiene, an epichlorohydrin-based rubber, a silicone rubber, a fluororubber, a polysulfide rubber, a potynorbornene rubber, a hydrogenated nitrite rubber, thermoplastic elastomers (such as a polystyrene-based elastomer, a polyolefin-based elastomer, a polyvinyl chloride-based elastomer, a polyurethane-based elastomer, a polyamide-based elastomer, a polyurea-based elastomer, a polyester-based elastomer, and a tluororesin-based elastomer), a mixture thereof, and the like. It should be noted that elastic layer 3 may be constituted of a plurality of layers composed of different materials.

A conducting agent may be added to elastic layer 3 to exhibit electric conductivity. For the conducting agent, only one type of conducting agent may be added, or a plurality of types of conducting agents may be added. The content of the conducting agent in elastic layer 3 is preferably, but not limited to, not less than 0.1 part by weight and not more than 30 parts by weight with respect to 100 parts by weight of the elastic layer material. The content of the conducting agent in elastic layer 3 is an amount with which desired volume resistivity of transfer belt 1 is realized in total. The volume resistivity of transfer belt 1 is not less than $10^8$ [Ω·cm] and not more than $10^{12}$ [Ω·cm], for example.

The conducting agent includes an ion conducting agent and an electron conducting agent. The ion conducting agent includes silver iodide, copper iodide, lithium perchlorate, lithium trifluoromethanesultbnate, lithium salt of organic boron complex, lithium his imide ($(CF_3SO_2)_2NLi$), and lithium iris methide ($(CF_3SO_2)_3CLi$). The electron conducting agent includes: metals, such as silver, copper, aluminum, magnesium, nickel, and stainless steel; and carbon compounds, such as graphite, carbon black, carbon nano fibers, and carbon nano tubes.

In addition to the conducting agent, elastic layer 3 may contain a non-fibrous resin and a fibrous resin.

Examples of the non-fibrous resin include thermosetting resins, such as a phenol resin, a thermosetting urethane resin, an epoxy resin, and a reactive monomer; and thermoplastic resins, such as polyvinyl chloride, polyvinyl acetate, and thermoplastic urethane. The content of the non-fibrous resin in elastic layer 3 with respect to the elastic layer material is preferably, but not limited to, not less than 20 parts by weight and not more than 60 parts by weight with respect to 100 parts by weight of the elastic layer material.

Examples of the fibrous resin include resin-based fibers such as cotton, hemp, silk, rayon, acetate, nylon, acrylic, vinylon, vinylidene, polyester, polystyrene, polypropylene, and aramid. The content of the fibrous resin in elastic layer 3 is preferably, but not limited to, not less than 10 parts by weight and not more than 40 parts by weight with respect to 100 parts by weight of the elastic layer material.

Elastic layer 3 may further contain commonly used additive agent(s) such as a vulcanizing agent, a vulcanization accelerator, a vulcanizing aiding agent, a co-crosslinking agent, a softener, and/or a plasticizer. One of these additive agents may be added solely or two or more of the additive agents may be added in combination.

Examples of the vulcanizing agent usable herein include sulfur, an organic sulfur-containing compound, an organic peroxide, and the like.

Moreover, examples of the co-crosslinking agent include ethylene glycol dimethacrylate, trimethylolpropane trimethacrylate, a polyfunctional methacrylate monomer, triallyl isocyanurate, a metal-containing monomer, and the like, each of which serves as a co-crosslinking agent with an organic peroxide. The added amount of the co-crosslinking agent in elastic layer 3 is preferably, but not limited to, not more than 5 parts by weight with respect to 100 parts by weight of the elastic layer material.

Although the material of front layer 4 is not particularly limited, front layer 4 is preferably composed of a material for improving transferability by reducing force of adhesion of toner to transfer belt 1. In view of this, for example, front layer 4 usable herein can be composed of a material in which powders or particles of one or two or more of a fluororesin, a fluorine compound, carbon fluoride, titanium dioxide, and silicon carbide are dispersed in a base material such as polyurethane, polyester, an epoxy resin, or a mixture thereof. It should be noted that front layer 4 may be obtained by modifying the surface of elastic layer 3.

The powders and particles employed herein are of a material for reducing surface energy of first main surface 1*a* to improve lubricity. These powders and particles may have different powder/particle sizes and may be dispersed therein. Alternatively, the surface energy of first main surface 1*a* may be also reduced by using a fluorine-based rubber material and performing heat treatment to form a fluorine-rich layer in the surface thereof.

It should be noted that front layer 4 does not necessarily need to be provided, and transfer belt 1 can be constituted only of base layer 2 and elastic layer 3. Moreover, transfer belt 1 may be constituted only of elastic layer 3 without providing base layer 2. Further, transfer belt 1 can include four or more layers by providing other layer(s) in addition to base layer 2, elastic layer 3, and front layer 4.

First main surface 1*a* of transfer belt 1 preferably has a 10-point average surface roughness Rz of not less than 0.5 [μm] and not more than 9.0 [μm], more preferably, not less than 3.0 [μm] and not more than 6.0 [μm]. When 10-point average surface roughness Rz is less than 0.5 [μm], transfer belt 1 may be adhered to a contact member. When 10-point average surface roughness Rz is more than 9.0 [μm], toner, paper powders, and the like may be more likely to be accumulated in the irregularity portion to result in deteriorated imaging quality. It should be noted that 10-point average surface roughness Rz refers to surface roughness defined in JIS B0601 (2001).

Here, transfer belt 1 in the present embodiment has a surface (i.e., first main surface 1*a*) having a portion deformed to exhibit a predetermined characteristic behavior when evaluated based on an evaluation method using a below-described displacement amount measuring device. Details thereof will be described later.

<Exemplary Usage of Transfer Belt>

Figure 2:
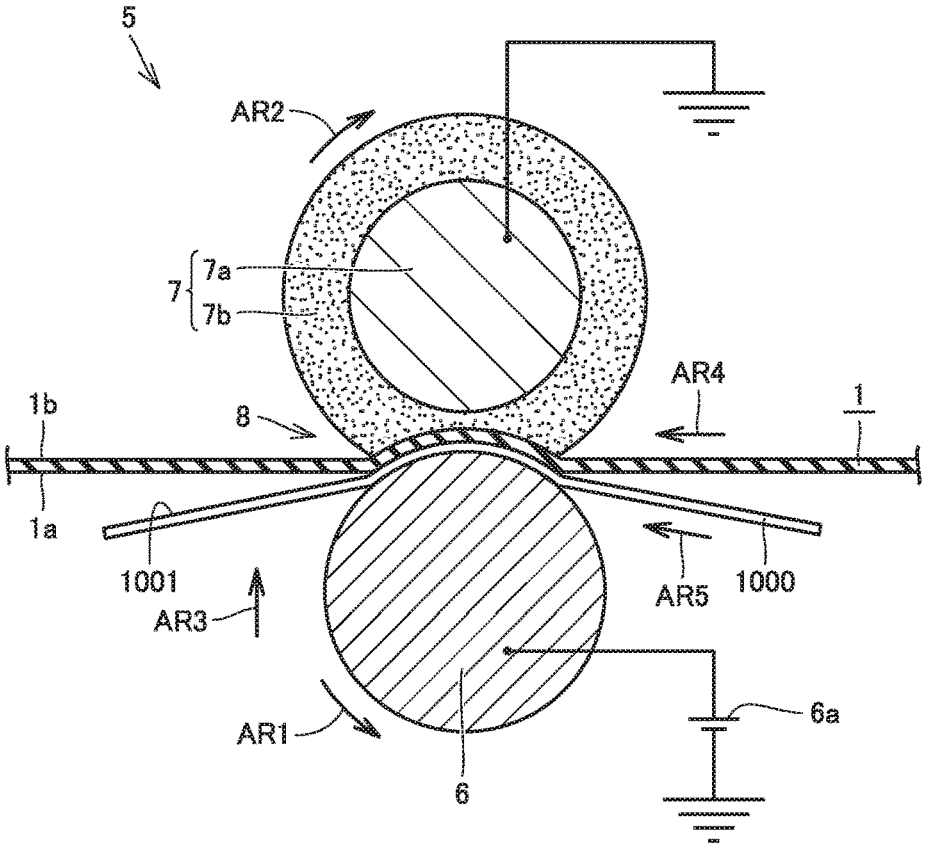
FIG. 2 is a schematic view of a secondary transfer portion to illustrate an exemplary usage of the transfer belt shown in FIG. 1.

FIG. 2 is a schematic view of a secondary transfer portion to illustrate one exemplary usage of the transfer belt shown in FIG. 1. Next, with reference to FIG. 2, the following describes the exemplary usage of transfer belt 1 in the present embodiment. It should be noted that the usage of transfer belt 1 in the present embodiment is not limited to this exemplary usage.

The exemplary usage of transfer belt 1 in FIG. 2 represents a specific example of a case where transfer belt 1 is attached to an electrophotographic image forming apparatus. In this case, transfer belt 1 is disposed to pass through a secondary transfer portion 5 of the image forming apparatus.

Secondary transfer portion 5 includes a secondary transfer roller 6 and a counter roller 7, which are disposed in parallel to face each other. A nip portion 8 is formed between secondary transfer roller 6 and counter roller 7. Transfer belt 1 is disposed to extend through this nip portion 8, and a recording medium 1000 is supplied to also pass through this nip portion 8.

Secondary transfer roller 6 is composed of a conductive material. A secondary transfer power supply 6*a* is connected to secondary transfer roller 6. Counter roller 7 includes: a core metal 7*a* composed of a conductive material; and a conductive elastic portion 7*b* covering a circumferential surface of core metal 7*a*. Core metal 7*a* is grounded. Accordingly, a predetermined electric field is formed in nip portion 8 by secondary transfer roller 6, counter roller 7, and secondary transfer power supply 6*a*.

Transfer belt 1 is disposed to extend therethrough at the counter roller 7 side relative to recording medium 1000, whereas recording medium 1000 is supplied to pass therethrough at the secondary transfer roller 6 side relative to transfer belt 1. It should be noted that transfer belt 1 is disposed such that first main surface 1*a* faces the recording medium 1000 side (i.e., the secondary transfer roller 6 side) and second main surface 1*b* faces the counter roller 7 side. Accordingly, first main surface 1*a* of transfer belt 1 is disposed to face recording surface 1001 of recording medium 1000 in nip portion 8.

Secondary transfer roller 6 is driven to rotate in an arrow AR1 direction shown in the figure, and counter roller 7 is driven to rotate in an arrow AR2 direction shown in the figure. Moreover, when transferring the toner image, secondary transfer roller 6 is pressed by a pressing structure (not shown) in an arrow AR3 direction shown in the figure, with the result that secondary transfer roller 6 is pressed into contact with counter roller 7 with transfer belt 1 and recording medium 1000 being interposed therebetween.

According to the rotation of secondary transfer roller 6 and the rotation of counter roller 7, transfer belt 1 and recording medium 1000 are respectively conveyed in an arrow AR4 direction and an arrow AR5 direction shown in the figure. On this occasion, transfer belt 1 and recording medium 1000 are sandwiched between secondary transfer roller 6 and counter roller 7 under application of pressure and are accordingly brought into close contact with each other when passing through nip portion 8. Moreover, on this occasion, the predetermined electric field described above acts on the closely contacted portions of transfer belt 1 and recording medium 1000. Accordingly, the toner on first main surface 1*a* of transfer belt 1 is adhered onto recording surface 1001 of recording medium 1000, thereby transferring the toner image.

Here, since the hardness of the surface of secondary transfer roller 6 is higher than the hardness of the surface of counter roller 7, the portions of transfer belt 1 and recording medium 1000 sandwiched between secondary transfer roller 6 and counter roller 7 are curved along the surface of secondary transfer roller 6. Accordingly, a recessively curved elongated surface is formed in first main surface 1*a* of transfer belt 1 to extend along the axial direction of secondary transfer roller 6. Onto this portion, the toner image is transferred.

Transfer belt 1 in the present embodiment can secure excellent transferability not only in a case where a sheet of regular paper having a surface provided with no particular irregularity is used as recording medium 1000, but also in a case where a sheet of embossed paper or the like having a surface provided with irregularity is used as recording medium 1000; however, a mechanism thereof will be described later, and the following describes details of the above-described evaluation method employing the displacement amount measuring device.

<Displacement Amount Measuring Device>

Figure 3A:
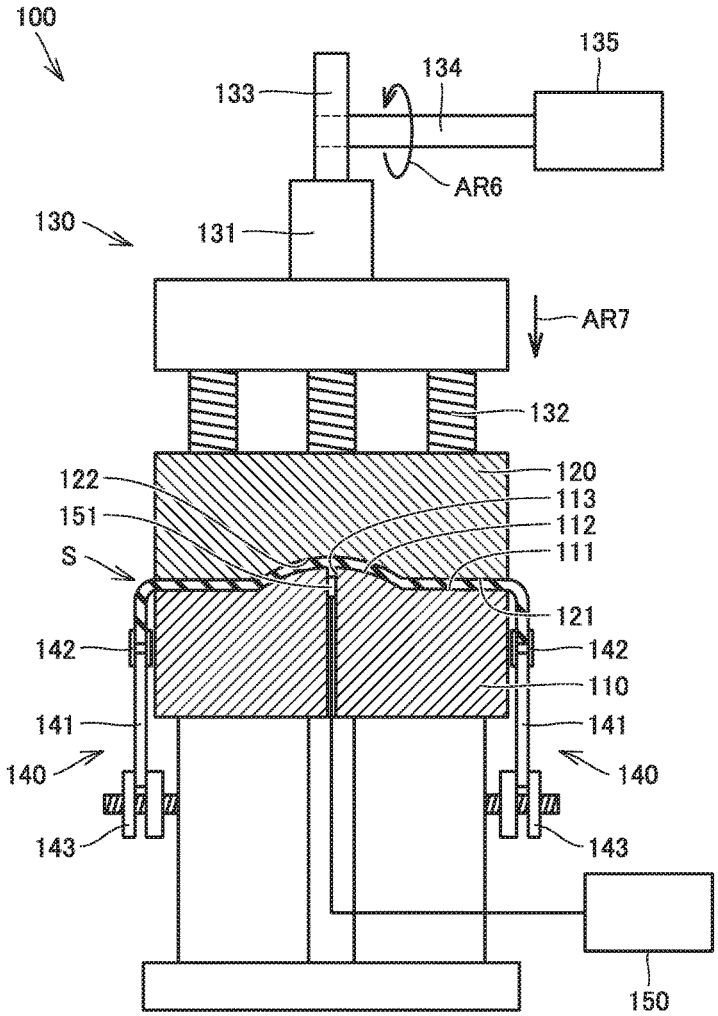
FIG. 3A is a schematic view showing a configuration of a displacement amount measuring device.
Figure 3B:
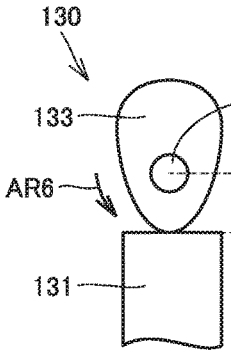
FIG. 3C is a schematic view showing an operation of a pressure applying structure included in the displacement amount measuring device.
Figure 3C:
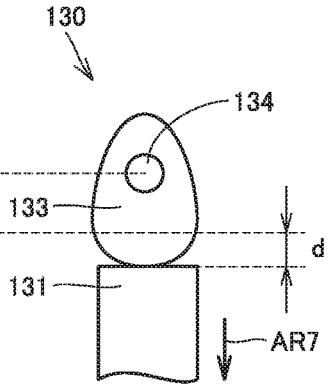
Figure 4A:
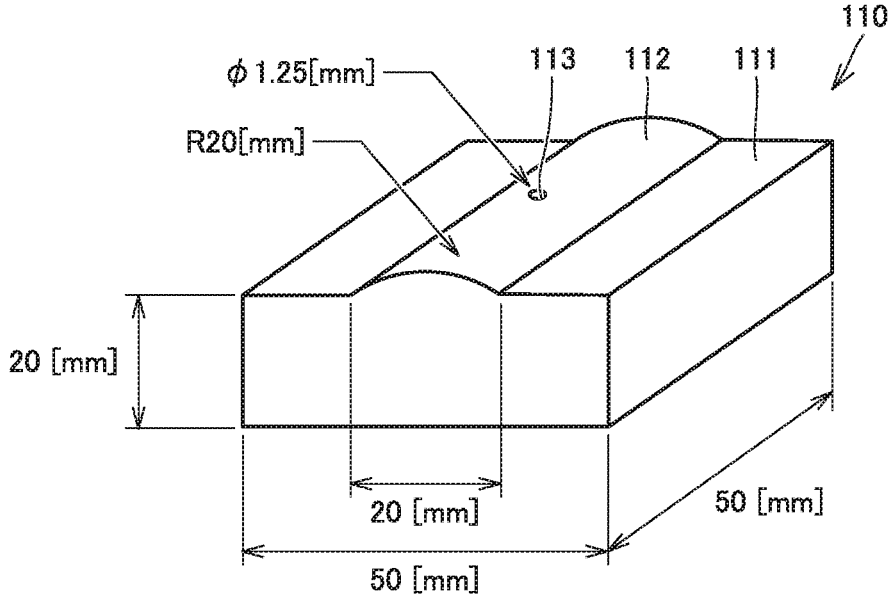
FIG. 4A is a perspective view of a lower block of the displacement amount measuring device shown in FIG. 3A.
Figure 4B:
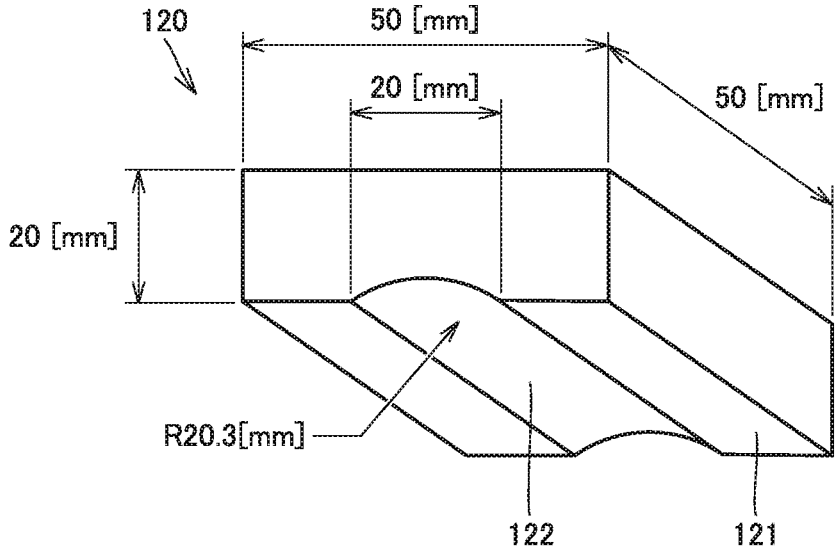
FIG. 4B is a perspective view of an upper block of the displacement amount measuring device shown in FIG. 3A.

FIG. 3A is a schematic view showing a configuration of the displacement amount measuring device, and each of FIG. 3B and FIG. 3C is a schematic view showing an operation of a pressure applying structure provided in the displacement amount measuring device. FIG. 4A is a perspective view showing a lower block of the displacement amount measuring device shown in FIG. 3A when viewed from above. FIG. 4B is a perspective view showing an upper block of the displacement amount measuring device shown in FIG. 3A when viewed from below.

As shown in FIG. 3A, displacement amount measuring device 100 mainly includes a lower block 110, an upper block 120, a pressure applying structure 130, a tension applying structure 140, and a displacement meter 150.

As shown in FIG. 3A and FIG. 4A, lower block 110 is constituted of an aluminum block having a width of 50 [mm], a depth of 50 [mm], and a height of 20 [mm]. Lower block 110 has a protrusively curved elongated surface 112 in its upper surface 111 at a central portion in the width direction. Protrusively curved elongated surface 112 has a width of 20 [mm]. Protrusively curved elongated surface 112 has a curvature radius of 20 [mm].

In the top portion of protrusively curved elongated surface 112 located along the depth direction of lower block 110, a hole 113 having a diameter of 1.25 [mm] (with a tolerance of ±0.02 [mm]) is provided at the central portion in the depth direction. It should be noted that a head portion 151 of displacement meter 150 is disposed at a position behind the opening plane of hole 113.

As shown in FIG. 3A and FIG. 4B, upper block 120 is constituted of an aluminum block having a width of 50 [min], a depth of 50 [mm], and a height of 20 [mm]. Upper block 120 has a recessively curved elongated surface 122 in its lower surface 121 at the central portion in the width direction. Recessively curved elongated surface 122 has a width of 20 [mm]. Recessively curved elongated surface 122 has a curvature radius of 20.3 [mm].

It should be noted that both a surface tolerance between upper surface 111 and protrusively curved elongated surface 112 of lower block 110 and a surface tolerance between lower surface 121 and recessively curved elongated surface 122 of upper block 120 are 0.02 [mm].

As shown in FIG. 3A, upper surface 111 of lower block 110 and lower surface 121 of upper block 120 are disposed to face each other. Here, lower block 110 and upper block 120 are positioned relative to each other, whereby protrusively curved elongated surface 112 and recessively curved elongated surface 122 are disposed to overlap with each other in the vertical direction.

Pressure applying structure 130 is disposed above upper block 120. Pressure applying structure 130 includes: a pressure applying member 131, which is a block-shaped member; a spring 132 disposed between pressure applying member 131 and upper block 120; a cam 133 disposed in contact with the upper surface of pressure applying member 131; a shaft 134 coupled to cam 133; and a drive motor 135 that drive to rotate shaft 134.

As shown in FIG. 3B and FIG. 3C, shaft 134 is driven by drive motor 135 to rotate in an arrow AR6 direction shown in the figure, with the result that cam 133 coupled to shaft 134 is rotated together with shaft 134. Accordingly, pressure applying member 131 is pressed down (in an arrow AR7 direction shown in the figure). Accordingly, upper block 120 is pressed down by pressure applying member 131 with spring 132 being interposed therebetween, thereby applying a load to upper block 120 vertically downward. It should be noted that the magnitude of the load is determined by a press-down amount d of pressure applying member 131. Press-down amount d of pressure applying member 131 can be adjusted by an amount of rotation of cam 133.

As shown in FIG. 3A, a belt S to be evaluated is disposed between lower block 110 and upper block 120. The both ends of belt S are drawn out from between lower block 110 and upper block 120. Tension applying structure 140 is connected to each of the both ends of belt S.

Tension applying structure 140 includes a film 141, a tape 142, and a weight 143. Film 141 is constituted of a film having a thickness of 100 [μm] and composed of polyethylene terephthalate. Tape 142 is constituted of an adhesive tape having a thickness of 30 [μm] and composed of polyimide. One end of film 141 is adhered to the end portion of belt S by tape 142, and weight 143 is attached to the other end of film 141. Here, tensile load provided by weight 143 is adjusted to 44 [N/m]. It should be noted that when belt S to be evaluated has a sufficient size, weight 143 may be directly attached to the both ends of belt S without using film 141 and tape 142 described above.

Displacement meter 150 serves to detect displacement of the surface of belt S, and head portion 151 of displacement meter 150 is disposed in hole 113 of lower block 110 to face belt S as described above. Here, for displacement meter 150, a micro head type spectral interference laser displacement meter provided by Keyence (spectral unit (model number: SI-F01U); head portion (model number: SI-F01)) is used.

<Evaluation Method>

Figure 5:
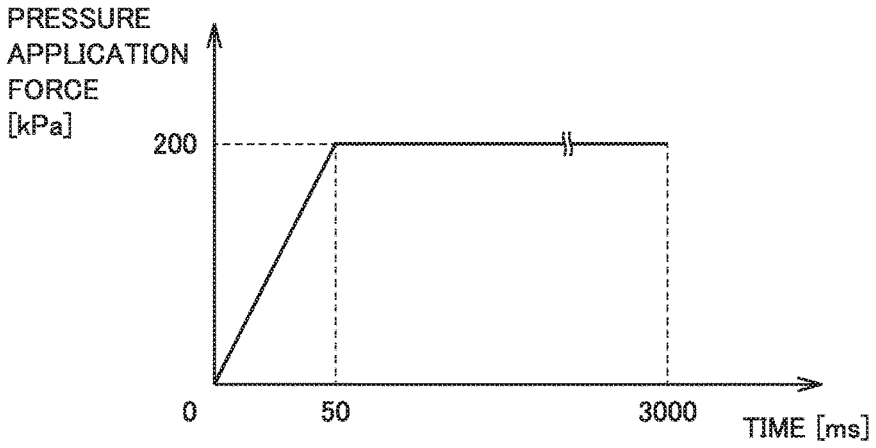
FIG. 5 is a graph for illustrating a belt evaluation method employing the displacement amount measuring device shown in FIG. 3A.
Figure 6:
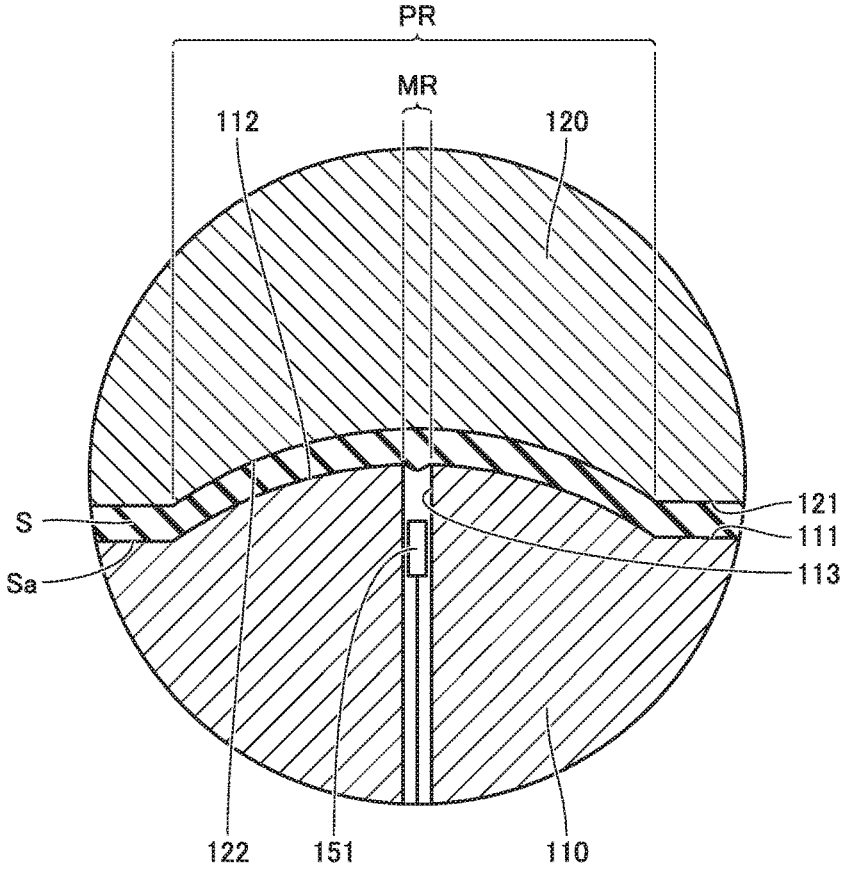
FIG. 6 is an enlarged cross sectional view near a hole of the lower block when a belt is pressed using the displacement amount measuring device shown in FIG. 3A.

FIG. 5 is a graph for illustrating the method for evaluating a belt using the displacement amount measuring device shown in FIG. 3A. Moreover, FIG. 6 is an enlarged cross sectional view illustrating a vicinity of the hole of the lower block when the belt is fed with pressure using the displacement amount measuring device shown in FIG. 3A.

Belt S is evaluated in the following procedure using displacement amount measuring device 100 shown in FIG. 3A. It should be noted that the evaluation is performed in an environment with a temperature of 20[° C.] and a humidity of 50[%].

First, before setting belt S in displacement amount measuring device 100, pressure distribution is measured at a contact portion between protrusively curved elongated surface 112 of lower block 110 and recessively curved elongated surface 122 of upper block 120. For the measurement of the pressure distribution, a tactile sensor (surface pressure distribution measuring system I-SCAN) provided by NITTA Corporation is used.

Specifically, a measurement unit of the tactile sensor is inserted between lower block 110 and upper block 120, pressure applying member 131 is pressed down, and pressure distribution after passage of 30 seconds is measured. This is repeated to adjust the pressure at and around the contact portion between protrusively curved elongated surface 112 and recessively curved elongated surface 122 to fall within a range of 200 [kPa]±40 [kPa].

Before the measurement, belt S is stored for 6 hours or more in an environment with a temperature of 20[° C.] and a humidity of 50 [%]. Belt S to be evaluated is sized to have a length of 60 [mm] corresponding to the width direction of each of lower block 110 and upper block 120 and have a length of 50 [mm] corresponding to the depth direction of each of lower block 110 and upper block 120. It should be noted that the length corresponding to the width direction of each of lower block 110 and upper block 120 may be not less than 35 [mm] and not more than 300 [mm], and the length corresponding to the depth direction of each of lower block 110 and upper block 120 may be not less than 50 [mm] and not more than 150 [mm]. When the length corresponding to the width direction of each of lower block 110 and upper block 120 is insufficient, weight 143 may be attached to the both ends of belt S using film 141 and tape 142 described above.

Next, the tactile sensor is removed, upper block 120 is moved down using pressure applying structure 130 such that lower block 110 and upper block 120 are lightly in contact with each other, and then this state is maintained for 30 seconds. Accordingly, the contact state is stabilized. Then, pressure applying structure 130 is used to press upper block 120 against lower block 110. It is assumed that a pressure application condition herein is the same as a below-described pressure application condition for belt S (for details, see the pressure application condition for belt S below).

Then, for 3 seconds from the start of application of pressure, the position of recessively curved elongated surface 122 of upper block 120 at the portion facing hole 113 of lower block 110 is measured using displacement meter 150 and is set as a below-described base line for displacement amount measurement of belt S.

Next, upper block 120 is moved up to bring upper block 120 out of contact with lower block 110, and then belt S is placed on upper surface 111 of lower block 110. On this occasion, first main surface Sa of belt S faces downward (i.e., faces the lower block 110 side). It should be noted that attention is to be paid not to introduce a foreign matter between belt S and lower block 110 and between belt S and upper block 120 when placing belt S thereon.

Next, upper block 120 is moved down using pressure applying structure 130 such that upper block 120 and belt S are lightly in contact with each other, and then this state is maintained for 30 seconds. Accordingly, the contact state is stabilized. Then, pressure applying structure 130 is used to press upper block 120 against belt S.

As shown in FIG. 5 and FIG. 6, belt S is pressed in the following manner: a pressed region PR of belt S to be sandwiched between protrusively curved elongated surface 112 and recessively curved elongated surface 122 is pressed for 50 [ms] with pressure application force increased at a pressure application rate of 4 [kPa/ms] until the pressure application force reaches 200 [kPa], and then pressed region PR is maintained to be pressed uniformly with the pressure application force of 200 [kPa]. The application of pressure to belt S is ended after 3 seconds from the start of application of pressure.

For the 3 seconds from the start of application of pressure to the end of application of pressure, the position of a measurement region MR is measured using displacement meter 150. Measurement region MR is a portion of first main surface Sa of belt S corresponding to hole 113 of lower block 110. On this occasion, a region of belt S located around the portion including measurement region MR of belt S is sandwiched and compressed between lower block 110 and upper block 120, with the result that the portion including measurement region MR of belt S is deformed to expand toward the inside of hole 113. As a result of this deformation, the position of measurement region MR is changed.

During each of the measurement of the base line and the measurement of the position of measurement region MR, the output of displacement meter 150 is sampled by a digital oscilloscope DL1640 provided by Yokogawa Electric Corporation. A sampling period on this occasion is set at 5 [ms].

Next, a difference between the measured position of measurement region MR and the base line is determined, thereby calculating displacement of measurement region MR of belt S as time series data.

It should be noted that the measurement described above is performed ten times in total with the position of belt S placed on lower block 110 being changed such that the position of measurement region MR relative to belt S to be measured becomes different.

<Typical Displacement Patterns>

When evaluating various belts each including an elastic layer by applying the above-described belt evaluation method employing displacement amount measuring device 100, the following two patterns can be confirmed typically as patterns representing behaviors of displacements of the measurement regions of the belts.

Figure 7:
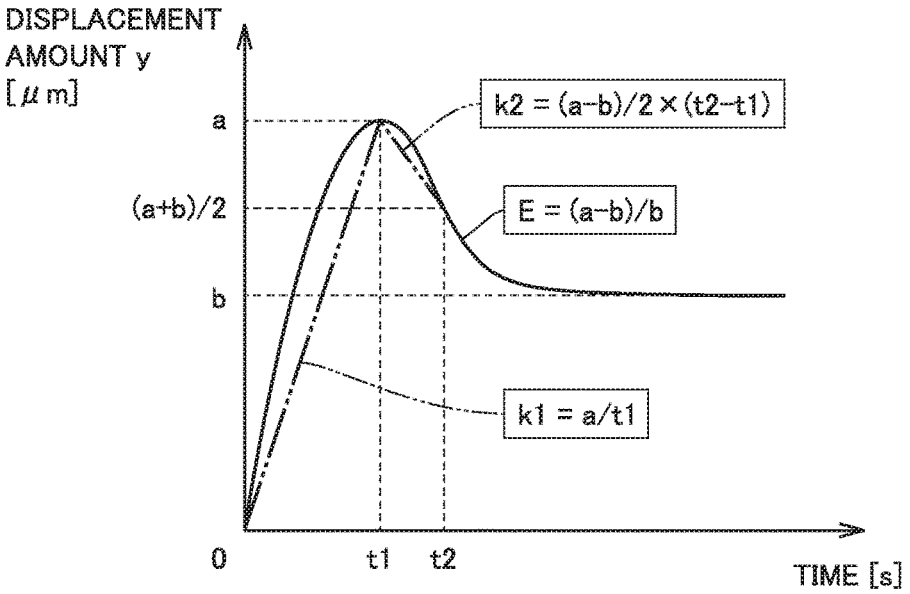
FIG. 7 is a graph showing a first pattern of behavior of displacement of a measurement region of a belt when evaluating the belt using the displacement amount measuring device shown in FIG. 3A.
Figure 8:
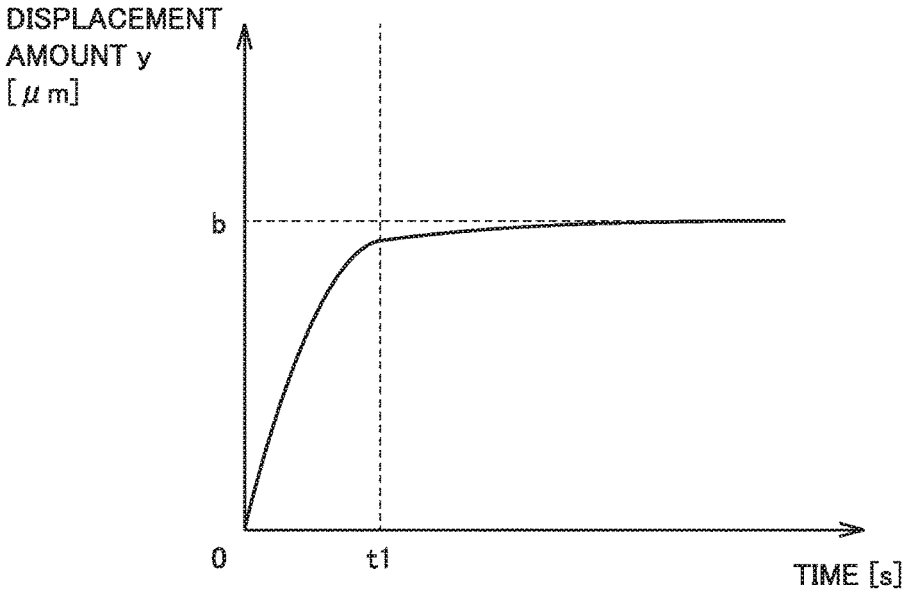
FIG. 8 is a graph showing a second pattern of behavior of displacement of the measurement region of the belt when evaluating a belt using the displacement amount measuring device shown in FIG. 3A.

FIG. 7 and FIG. 8 are graphs respectively showing first and second patterns of the behaviors of displacements of the measurement regions of the belts.

As shown in FIG. 7, the first pattern is such a pattern that: a displacement amount y of measurement region MR of belt S is increased by increasing the pressure application force for applying pressure to belt S after starting the application of pressure; a local peak of the displacement of measurement region MR of belt S appears around a point of time (i.e., 50 [ms]) when the pressure application force for pressing belt S reaches 200 [kPa]; then displacement amount y of measurement region MR of belt S starts to be decreased; and displacement amount y of measurement region MR of belt S is gradually decreased with passage of time to finally converge at a predetermined displacement amount. Specifically, it can be said that the first pattern has an overshoot portion in the transition of the displacement of measurement region MR of belt S. In the description below, the term "primary displacement" is employed to represent the displacement in the phase of increase of displacement amount y of measurement region MR of belt S in the first pattern, whereas the term "secondary displacement" is employed to represent the displacement in the phase of decrease of displacement amount y of measurement region MR of belt S in the first pattern.

On the other hand, as shown in FIG. 8, the second pattern is such a pattern that: displacement amount y of measurement region MR of belt S is increased according to increase of pressure application force for applying pressure onto belt S after the start of the application of pressure; no local peak appears around a point of time (i.e., 50 [ms]) when the pressure application force for applying pressure onto belt S reaches 200 [kPa]; and then displacement amount y of measurement region MR of belt S is increased gradually to converge at a predetermined displacement amount. Specifically, it can be said that the second pattern has no overshoot portion in the transition of displacement of measurement region MR of belt S.

<Pattern of Displacement of Transfer Belt in the Present Embodiment>

Transfer belt 1 in the present embodiment is configured to exhibit the first pattern (i.e., the pattern with the overshoot portion) when evaluated by applying the belt evaluation method employing displacement amount measuring device 100 described above in detail.

This is based on such a finding obtained by the present inventors that: when a plurality of types of belts exhibiting the first pattern and a plurality of types of belts exhibiting the second pattern were prepared and each of these belts was used as an intermediate transfer belt of an image forming apparatus to form an image on a sheet of embossed paper, transferability when using the belt exhibiting the first pattern is much more excellent than transferability when using the belt exhibiting the second pattern. It should be noted that details of experiments to obtain this finding (inclusive of a below-described experiment for checking a relation between ΔVadh and each of overshoot ratio E, primary displacement ratio k1 and secondary displacement ratio k2, as well as a below-described experiment for checking performance) will be described later.

High transferability can be secured in the belt exhibiting the first pattern because the front surface (i.e., first main surface) of the transfer belt is basically shook greatly when the transfer belt is fed with pressure from the backside surface (i.e., second main surface) side although details thereof will be described later. Therefore, attention should be paid to the above-described overshoot portion in order to realize a transfer belt that can secure high transferability to a recording medium, such as embossed paper, having a recording surface provided with irregularity.

Here, with reference to FIG. 7, a [μm] is defined to represent the maximum value of displacement amount y, which is a local peak of the displacement of measurement region MR of belt S, whereas b [μm] is defined to represent a convergence value of displacement amount y after the displacement of measurement region MR of belt S is converged. Further, t1 [s] is defined to represent a period of time from the point of time at which pressure is started to be applied to the point of time at which maximum value a [μm] is observed, whereas t2 [s] is defined to represent a period of time from the point of time at which pressure is started to be applied to a point of time at which displacement amount y of measurement region MR of belt S reaches (a+b)/2 again after maximum value a [μm] is observed.

In addition, overshoot ratio E [−], primary displacement ratio k1 [μm/s], and secondary displacement ratio k2 [μm/s] are defined as parameters indicating characteristic behaviors of the displacement of measurement region MR of belt S in the first pattern.

Overshoot ratio E [−] is a parameter indicating the size of the overshoot, and is calculated by E=(a−b)/b.

Primary displacement ratio k1 [μm/s] is a parameter indicating an increase ratio (i.e., ratio of increase of the displacement amount) of the primary displacement, which is displacement until the local peak is reached, and is determined by k1=a/t1.

Secondary displacement ratio k2 [μm/s] is a parameter indicating a decrease ratio (i.e., ratio of decrease of the displacement amount) of the secondary displacement, which is displacement after the local peak is reached, and is determined by k2 (a−b)/{2×(t2−t1)}.

Overshoot ratio E [−], primary displacement ratio k1 [μm/s], and secondary displacement ratio k2 [μm/s] are parameters each indicating a degree of shaking of the front surface (i.e., first main surface) when the transfer belt is fed with pressure from the backside surface (i.e., second main surface) side. As the shaking of the front surface of the transfer belt involves a greater change, these parameters have larger values.

More specifically, when overshoot ratio E [−] has a relatively large value, the front surface of the transfer belt is displaced more greatly. Moreover, as primary displacement ratio k1 [μm/s] has a relatively larger value, the primary displacement of the transfer belt takes place at a higher speed. Moreover, as secondary displacement ratio k2 [μm/s] has a relatively larger value, the secondary displacement of the transfer belt takes place at a higher speed.

Here, transfer belt 1 in the present embodiment satisfies at least one of the following first to third conditions. It should be noted that the first to third conditions have been derived from results of the below-described experiment for checking the relation between ΔVadh and each of overshoot ratio E, primary displacement ratio k1, and secondary displacement ratio k2, as well as the below-described experiment for checking performance.

The first condition is such a condition that overshoot ratio E [−] satisfies 0.2≤E≤3. When transfer belt 1 satisfies the first condition, high transferability to a recording medium having a surface provided with irregularity can be attained and image quality can be suppressed from being deteriorated due to repeated use.

When overshoot ratio E [−] satisfies E<0.2, the front surface is not shook much even when the transfer belt is fed with pressure from the backside surface side, with the result that no sufficient effect can be expected in terms of transferability. On the other hand, when overshoot ratio E [−] satisfies 3<E, the transfer belt may be cracked or worn at an early stage due to repeated use, resulting in a concern of deterioration of image quality.

The second condition is such a condition that primary displacement ratio k1 [μm/s] satisfies 60≤k1≤320. When transfer belt 1 satisfies the second condition, high transferability to a recording medium having a surface provided with irregularity can be attained and image quality can be suppressed from being deteriorated by repeated use.

When primary displacement ratio k1 [μm/s] satisfies k1≤60, the front surface is not shook much even when the transfer belt is fed with pressure from the backside surface side, with the result that no sufficient effect can be expected in terms of transferability. On the other hand, when primary displacement ratio k1 [μm/s] satisfies 320<k1, the transfer belt may be cracked or worn at an early stage due to repeated use, resulting in a concern of deterioration of image quality.

The third condition is such a condition that secondary displacement ratio k2 [μm/s] satisfies 6≤k2≤30. When transfer belt 1 satisfies the third condition, high transferability to a recording medium having a surface provided with irregularity can be attained and image quality can be suppressed from being deteriorated due to repeated use.

When secondary displacement ratio k2 [μm/s] satisfies k2<6, the front surface is not shook much even when the transfer belt is fed with pressure from the backside surface side, with the result that no sufficient effect can be expected in terms of transferability. On the other hand, when secondary displacement ratio k2 [μm/s] satisfies 30<k2, the transfer belt may be cracked or worn at an early stage due to repeated use, resulting in a concern of deterioration of image quality.

Here, when transfer belt 1 satisfies one of the first to third conditions, sufficiently high transferability can be secured; however, higher transferability can be secured when transfer belt 1 satisfies two of the first to third conditions, and very high transferability can be secured when transfer belt 1 satisfies all of the first to third conditions.

In addition, when at least one of the first to third conditions is satisfied, it is preferable that convergence value b [μm] satisfies a condition of 4≤b≤8 as a fourth condition. When transfer belt 1 additionally satisfies the fourth condition, high transferability and suppression of deteriorated image quality can be more securely attained.

It should be noted that each of overshoot ratio E [−], primary displacement ratio k1 [μm/s], and secondary displacement ratio k2 [μm/s] is determined by calculating an average value of four of values calculated from a total of ten pieces of time series data obtained by changing the positions of measurement region MR with the three largest values and the three smallest values being excluded in the belt evaluation method employing displacement amount measuring device 100.

<Relation Between Displacement Pattern and Transferability>

Next, the following fully describes a reason why high transferability can be secured when an image is formed on a sheet of embossed paper using the belt exhibiting the first pattern as the intermediate transfer belt of the image forming apparatus.

Figure 9A:
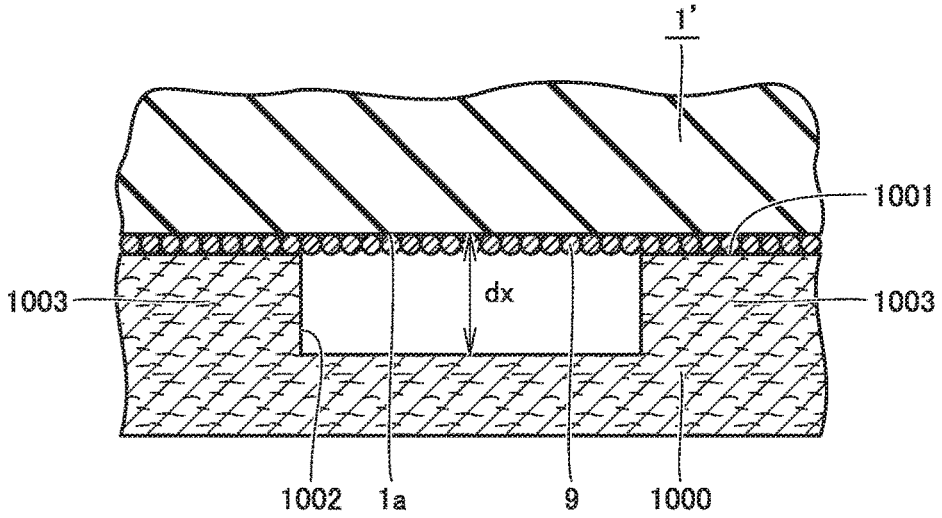
FIG. 9A is a schematic view for illustrating movement of toner from a transfer belt onto a sheet of embossed paper when the transfer belt used herein is constituted of only an inelastic layer.
Figure 9B:
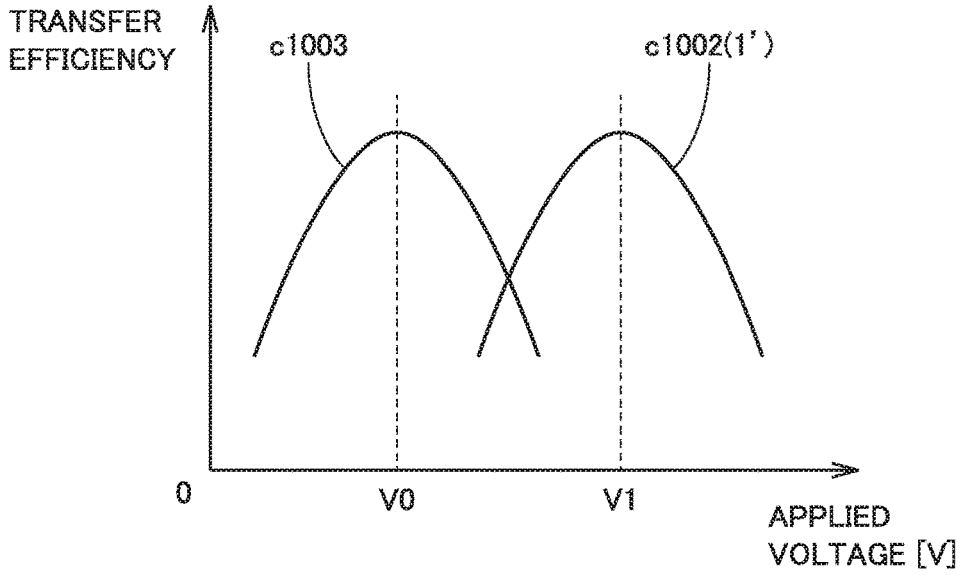
FIG. 9B is a graph for illustrating a relation between applied voltage and transfer efficiency when the transfer belt used herein is constituted of only the inelastic layer.

FIG. 9A is a schematic view showing movement of toner to a sheet of embossed paper from a transfer belt constituted of only an inelastic layer. FIG. 9B is a graph showing a relation between applied voltage and transfer efficiency in that case.

As shown in FIG. 9A, when a toner image is transferred onto a sheet of embossed paper 1000 using a transfer belt constituted of only an inelastic layer, a recording surface 1001 of the sheet of embossed paper 1000 at a portion (hereinafter, this portion will be referred to as "protrusion 1003" for the sake of convenience) with no recess 1002 is in contact with toner 9 located on first main surface 1*a* of transfer belt 1'. On the other hand, recording surface 1001 of the sheet of embossed paper 1000 at a portion with recess 1002 is not in contact with toner 9 located on first main surface 1*a* of transfer belt 1'.

Accordingly, in order to move toner 9 to the bottom surface of recess 1002 of the sheet of embossed paper 1000, toner 9 needs to fly from transfer belt 1'. In order for toner 9 to fly from transfer belt 1', force received by toner 9 from the electric field needs to be higher than force of adhesion of toner 9 to transfer belt P. It should be noted that the force of adhesion is a total of non-electrostatic adhesion force (van der Waals force) and electrostatic adhesion force (electrostatic attractive force by charges of the charged toner and charges of a mirror image on the transfer belt).

Here, force F received by toner 9 from the electric field is represented by $F=q\times dV/dx$, where q represents an amount of charges of toner 9, dV represents an electric potential difference between the sheet of embossed paper 1000 and transfer belt 1', and dx represents a distance between the sheet of embossed paper 1000 and transfer belt 1'. Since force F is proportional to electric potential difference dV between the sheet of embossed paper 1000 and transfer belt as understood from this relation, applied voltage required for toner 9 to fly becomes larger as distance dx becomes longer.

Therefore, as shown in FIG. 9B, applied voltage V1 for attaining the maximum transfer efficiency in recess 1002 becomes higher than applied voltage V0 for attaining the maximum transfer efficiency in protrusion 1003. It should be noted that in FIG. 9B, a reference character c1003 is provided to a curve indicating a relation between the applied voltage and the transfer efficiency for protrusion 1003, and a reference character c1002 (1') is provided to a curve indicating a relation between the applied voltage and the transfer efficiency for recess 1002.

Normally, in the image forming apparatus, the applied voltage is set at a voltage around applied voltage V0 for attaining the maximum transfer efficiency in protrusion 1003. Therefore, as the transfer efficiency in recess 1002 is higher under the voltage around applied voltage V0, an image density difference become smaller between recess 1002 and protrusion 1003 of the sheet of embossed paper 1000, thereby obtaining an image with high quality.

Figure 10A:
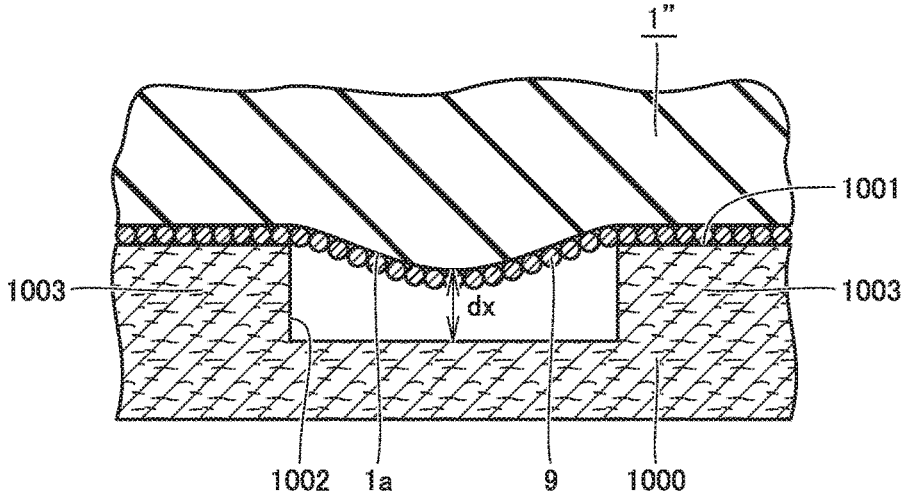
FIG. 10A is a schematic view for illustrating movement of toner from a transfer belt onto a sheet of embossed paper when the transfer belt used herein includes an elastic layer.
Figure 10B:
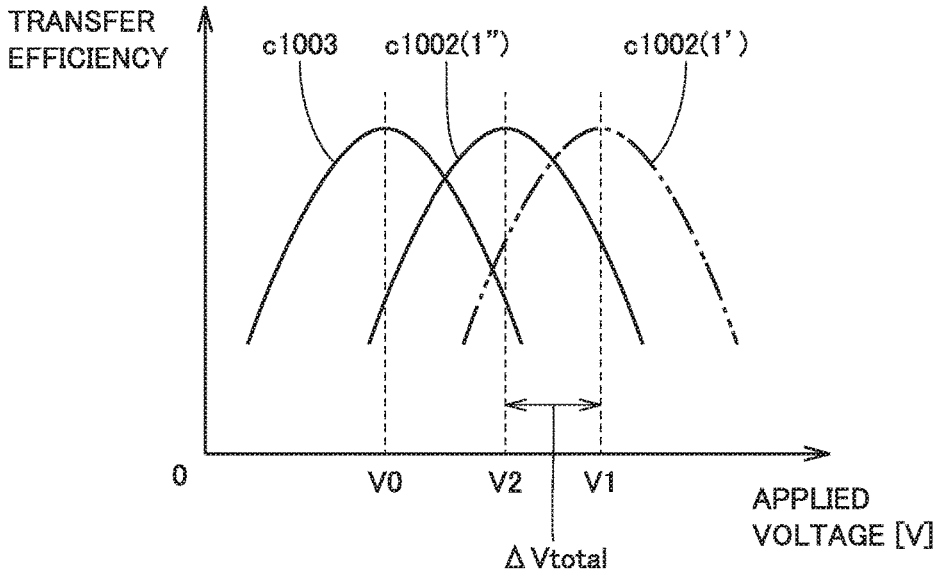
FIG. 10B is a graph for illustrating a relation between applied voltage and transfer efficiency when the transfer belt used herein includes the elastic layer.

FIG. 10A is a schematic view showing movement of toner to a sheet of embossed paper from a transfer belt including an elastic layer. FIG. 10B is a graph showing a relation between applied voltage and transfer efficiency in that case.

As shown in FIG. 10A, when a transfer belt 1" including an elastic layer is used, transfer belt 1" is generally deformed such that a portion of transfer belt 1" at the first main surface 1*a* side enters a recess 1002 of a sheet of embossed paper 1000, thereby reducing a distance dx between the bottom surface of recess 1002 of the sheet of embossed paper 1000 and transfer belt 1". This leads to an effect of providing decreased applied voltage for attaining the maximum transfer efficiency in recess 1002. This effect is a conventionally known effect, and is referred to as "deformation following effect" herein.

Meanwhile, when transfer belt 1" including the elastic layer exhibits the first pattern, first main surface 1*a* is shook greatly upon the deformation of transfer belt 1" and is accordingly deformed to expand and contract, thereby changing a positional relation between transfer belt 1" and toner 9 adhered thereto (i.e., changing the distance or contact area between toner 9 and first main surface 1*a*). Accordingly, the force of adhesion of toner 9 to transfer belt 1" is decreased. This leads to an effect of providing further decreased applied voltage for attaining the maximum transfer efficiency in recess 1002. This effect is not a conventionally known effect, is an effect found by the present inventors this time, and is referred to as "adhesion force reduction effect" herein.

Accordingly, as shown in FIG. 10B, applied voltage V2 for attaining the maximum transfer efficiency in recess 1002 becomes smaller than applied voltage V1 for attaining the maximum transfer efficiency in recess 1002 when transfer belt 1' constituted of only the inelastic layer is used. It should be noted that in FIG. 10B, a reference character c1002 (1") is provided to a curve showing a relation between the applied voltage and the transfer efficiency for recess 1002.

Therefore, the transfer efficiency in recess 1002 becomes higher under a voltage around applied voltage V0 than that in the case where transfer belt 1' constituted of only the inelastic layer is used, thereby reducing the image density difference between recess 1002 and protrusion 1003 of the sheet of embossed paper 1000. Accordingly, an image with higher quality is obtained. Hereinafter, this will be described more in detail.

Figure 11:
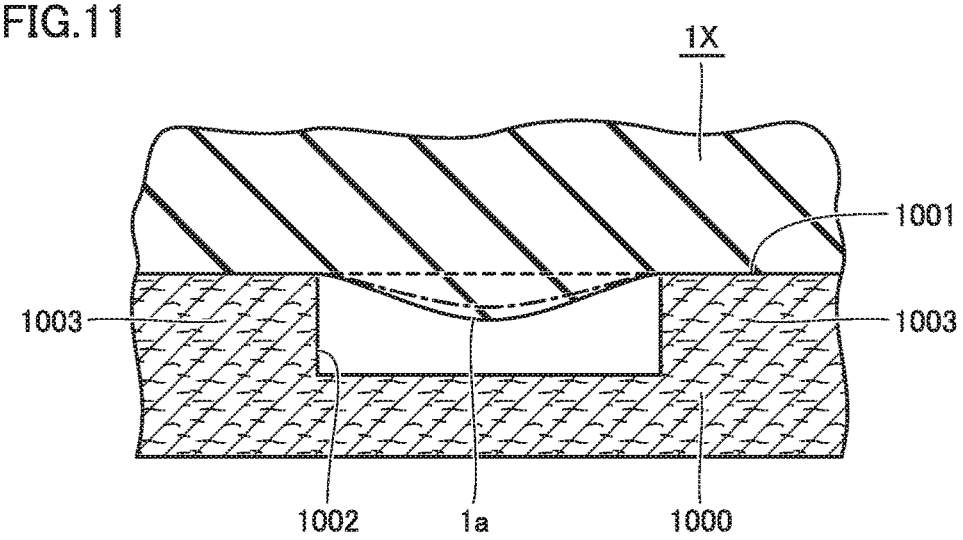
FIG. 11 is a schematic view for illustrating behavior of a belt exhibiting the second pattern shown in FIG. 8 with respect to a recess of the sheet of embossed paper when the belt is used as a transfer belt.
Figure 12:
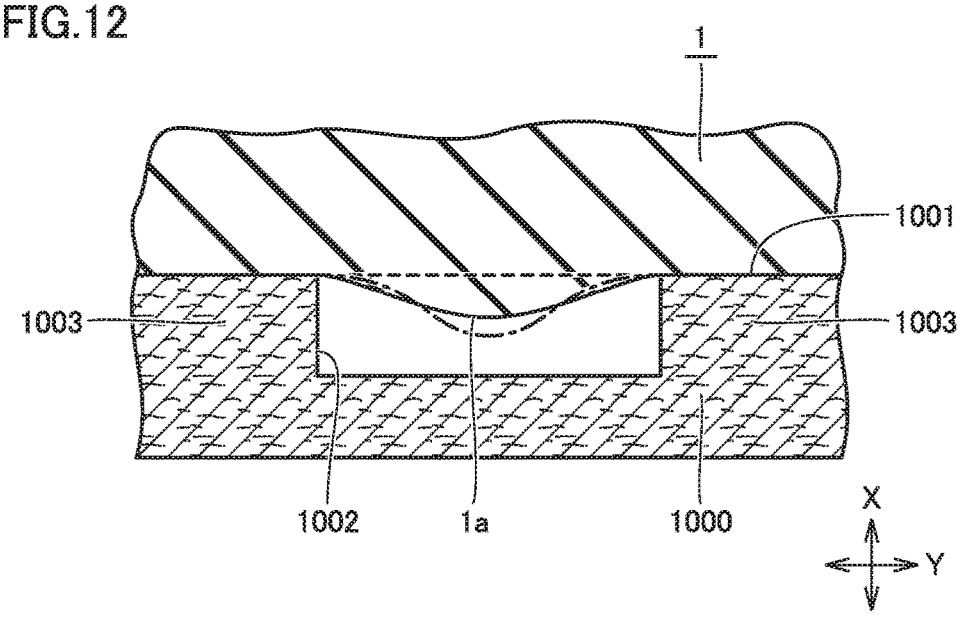
FIG. 12 is a schematic view for illustrating behavior of a belt exhibiting the first pattern shown in FIG. 7 with respect to the recess of the sheet of embossed paper when the belt is used as a transfer belt.

FIG. 11 is a schematic view for illustrating behavior of a belt exhibiting the second pattern shown in FIG. 8 with respect to the recess of the sheet of embossed paper when the belt is used as a transfer belt. FIG. 12 is a schematic view for illustrating behavior of a belt exhibiting the first pattern shown in FIG. 7 with respect to the recess of the sheet of embossed paper when the belt is used as a transfer belt. It should be noted that for ease of understanding, toner is not illustrated in FIG. 11 and FIG. 12.

As described above, when the transfer belt passes through the nip portion of the secondary transfer portion, the transfer belt and the sheet of embossed paper is sandwiched between and pressed by the secondary transfer roller and the counter roller. On this occasion, generally, pressure received at one point on the transfer belt in the nip portion is temporally changed in such a manner that pressure is increased rapidly at the inlet portion of the nip portion, then the pressure is relatively unchanged, and then the pressure is decreased rapidly at the outlet portion of the nip portion.

When the belt exhibiting the second pattern shown in FIG. 8 is used as a transfer belt 1X, behavior of first main surface 1*a* of transfer belt 1X with respect to recess 1002 of the sheet of embossed paper 1000 is as shown in FIG. 11. Here, in FIG. 11, a broken line represents a position of first main surface 1*a* when no displacement occurs. An alternate long and short dash line represents a position of first main surface 1*a* at a point of time of start of the phase in which the pressure is relatively unchanged after the rapid increase in pressure onto transfer belt 1X. A solid line represents a position of first main surface 1*a* at a subsequent point of time of start of the rapid decrease of the pressure after the phase in which the pressure is relatively unchanged.

In this case, transfer belt 1X is deformed such that a portion of first main surface 1*a* facing recess 1002 of the sheet of embossed paper 1000 enters recess 1002 of the sheet of embossed paper 1000, thereby reducing the distance between the bottom surface of recess 1002 of the sheet of embossed paper 1000 and transfer belt 1X. Accordingly, the deformation following effect described above is obtained.

However, in this case, the displacement of the portion of first main surface 1*a* facing recess 1002 is based on such simple deformation that first main surface 1*a* is moved toward the bottom surface of recess 1002. Accordingly, first main surface 1*a* is not shook greatly and is only slightly deformed to be extended.

Therefore, the positional relation between first main surface 1*a* and the toner adhered thereto is not changed greatly, with the result that the force of adhesion of the toner to transfer belt 1X is not reduced greatly. Accordingly, the above-described adhesion force reduction effect is hardly obtained.

On the other hand, when the belt exhibiting the first pattern shown in FIG. 7 is used as transfer belt 1, behavior of first main surface 1*a* of transfer belt 1 with respect to recess 1002 of the sheet of embossed paper 1000 is as shown in FIG. 12. Here, in FIG. 12, a broken line represents a position of first main surface 1*a* when no displacement occurs. An alternate long and short dash line represents a position of first main surface 1*a* at a point of time of start of the phase in which the pressure is relatively unchanged after the rapid increase in pressure onto transfer belt 1. A solid line represents a position of first main surface 1*a* at a subsequent point of time of start of the rapid decrease of the pressure after the phase in which the pressure is relatively unchanged.

In this case, transfer belt 1 is deformed such that a portion of first main surface 1*a* facing recess 1002 of the sheet of embossed paper 1000 enters recess 1002 of the sheet of embossed paper 1000, thereby reducing the distance between the bottom surface of recess 1002 of the sheet of embossed paper 1000 and transfer belt 1. Accordingly, the deformation following effect described above is obtained.

Further, in this case, strain of the elastic layer included in transfer belt 1 is concentrated on the center of a portion of first main surface 1*a* facing recess 1002, with the result that primary displacement occurs in this portion to cause the maximum displacement of first main surface 1*a*, and then the secondary displacement, which is reverting displacement, occurs to cause first main surface 1*a* to move away from the bottom surface of recess 1002.

On this occasion, the portion of first main surface 1*a* facing, recess 1002 is deformed not only in the normal direction (X direction shown in the figure) of first main surface 1*a* in the state before the deformation of transfer belt 1 but also in a direction (Y direction shown in the figure) orthogonal to the normal direction. These deformations are overlapped with each other, thereby causing high-speed and complicated deformation of first main surface 1*a*.

As a result, the positional relation between first main surface 1*a* and the toner adhered thereto is changed greatly, thereby significantly reducing the force of adhesion of the toner to transfer belt 1. Accordingly, not only the deformation following effect but also the adhesion force reduction effect are obtained, thereby achieving high transferability to a sheet of embossed paper or the like having a deeper recess.

Thus, the adhesion force reduction effect is particularly remarkably obtained in the transfer belt exhibiting the first pattern, and a degree of the obtained effect is greatly related with the above-described overshoot portion in the first pattern. Specifically, when primary displacement ratio k1 [μm/s] is sufficiently large, the primary displacement of first main surface 1*a* of transfer belt 1 occurs at a high speed in the initial stage of passage of transfer belt 1 through the nip portion, thereby obtaining a high adhesion force reduction effect. Further, when overshoot ratio E [–] is sufficiently large, first main surface 1*a* of transfer belt 1 is deformed at a high speed in a complicated manner in the middle stage of passage of transfer belt 1 through the nip portion, thereby obtaining a high adhesion force reduction effect. In addition, when secondary displacement ratio k2 [μm/s] is sufficiently large, secondary deformation of first main surface 1*a* of transfer belt 1 occurs at a high speed in the final stage of passage of transfer belt 1 through the nip portion, thereby obtaining a high adhesion force reduction effect.

Here, with reference to FIG. 10B, $\Delta V_{total}=\Delta V_{gap}-\Delta V_{adh}$ is established, where $\Delta V_{total}$ represents a difference between applied voltage V1 and applied voltage V2, $\Delta V_{gap}$ represents an amount of reduction of the applied voltage for attaining the maximum transfer efficiency in recess 1002 due to the deformation following effect, and $\Delta V_{adh}$ represents an amount of reduction of the applied voltage for attaining the maximum transfer efficiency in recess 1002 due to the adhesion force reduction effect.

Since $\Delta V_{total}$ is represented by V1-V2 as described above, $\Delta V_{adh}$ is represented by V1-V2-$\Delta V_{gap}$. Although each of V1 and V2 has an intrinsic value for each transfer belt, the value thereof can be derived through an experiment. $\Delta V_{gap}$ can be derived experimentally from displacement amount y of measurement region MR of belt S measured using the above-described belt evaluation method employing displacement amount measuring device 100. Therefore, based on these values, $\Delta V_{adh}$ can be determined by calculation.

<Experiment for Checking Relation Between $\Delta V_{adh}$ and Each of Overshoot Ratio E, Primary Displacement Ratio k1, and Secondary Displacement Ratio k2>

The present inventors manufactured a multiplicity of belts including elastic layers having different compositions by preparing various types and amounts of resins, additive agents, crosslinking agents and the like to be included in the elastic layers. These belts were evaluated based on the belt evaluation method employing displacement amount measuring device 100 to determine overshoot ratio E, primary displacement ratio k1, and secondary displacement ratio k2 of each of the belts.

From these belts, a plurality of belts having different overshoot ratios E, primary displacement ratios k1, and secondary displacement ratios k2 were selected. Each of the plurality of selected belts was used to experimentally measure efficiency of transfer to a recess of a sheet of embossed paper, thereby determining the value of V2 of each belt. Here, V2 was measured in the following manner: displacement amount measuring device 100 shown in FIG. 3A was employed; the belt to be measured and the sheet of embossed paper were sandwiched between lower block 110 and upper block 120; voltage was applied to lower block 110 and upper block 120 to cause a potential difference between lower block 110 and upper block 120; and the applied voltage was changed variously to find, as V2, a voltage for attaining the best transfer efficiency.

Meanwhile, similar measurement was performed using inelastic belts to determine the value of V1 of each belt. Based on a displacement amount of measurement region MR of each belt measured by the belt evaluation method employing displacement amount measuring device 100, $\Delta V_{gap}$ was determined by calculation.

Figure 13:
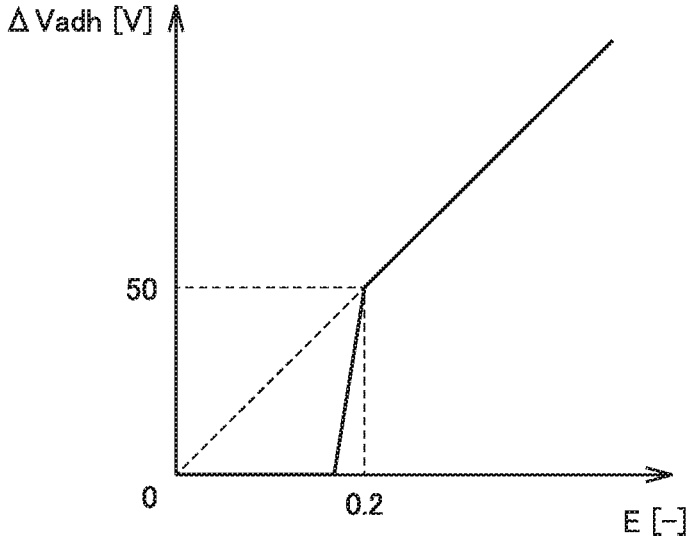
FIG. 13 is a graph showing a relation between an overshoot ratio E and ΔVadh.
Figure 14:
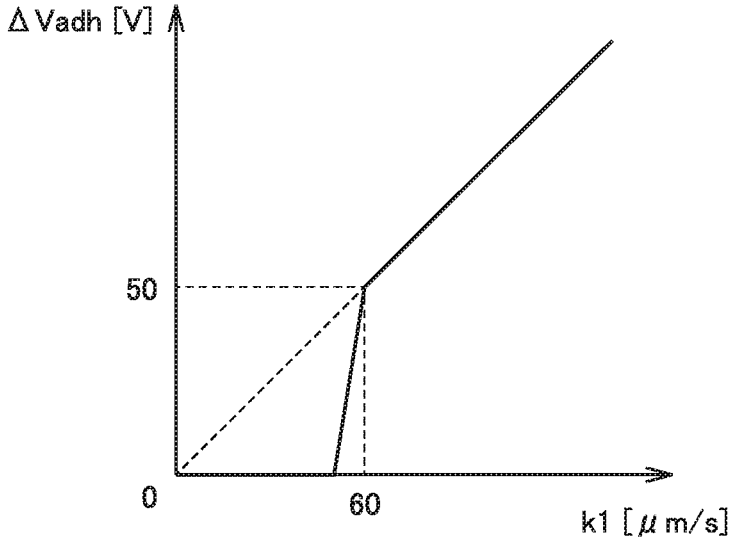
FIG. 14 is a graph showing a relation between a primary displacement ratio k1 and ΔVadh.
Figure 15:
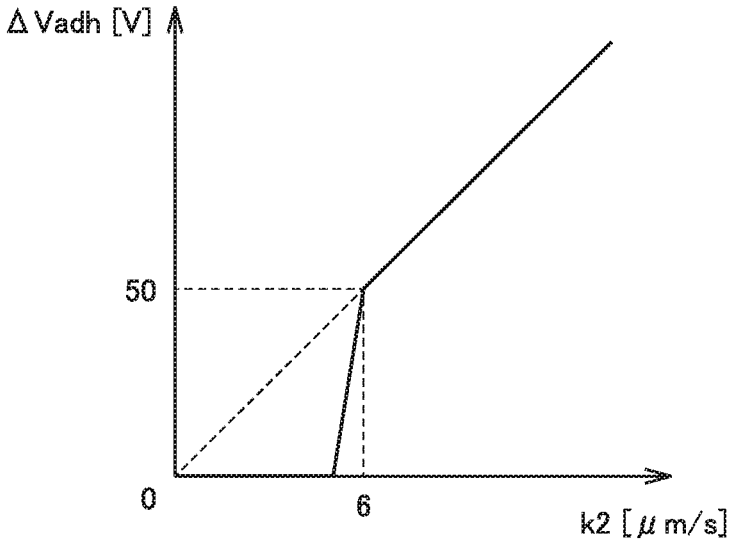
FIG. 15 is a graph showing a relation between a secondary displacement ratio k2 and ΔVadh.

Based on the data of each of these belts, a relation between $\Delta V_{adh}$ and each of overshoot ratio E, primary displacement ratio k1, and secondary displacement ratio k2 is established. FIG. 13 is a graph showing a relation between overshoot ratio E and $\Delta V_{adh}$. Moreover, FIG. 14 is a graph showing a relation between primary displacement ratio k1 and ΔVadh. FIG. 15 is a graph showing a relation between secondary displacement ratio k2 and ΔVadh. It should be noted that since displacement amount y has no local peak in the belt exhibiting the second pattern, displacement amount y at 50 [ms] was set as maximum value a.

As understood from FIG. 13, in the relation between overshoot ratio E and ΔVadh, ΔVadh was less than 50 [V] when overshoot ratio E was in the range of $0 \leq E < 0.2$, thus confirming that substantially no adhesion force reduction effect was obtained. On the other hand, when overshoot ratio E was in the range of $0.2 \leq E$, ΔVadh tended to be increased to more than 50[V] as the value of overshoot ratio E became larger, thus confirming that a high adhesion force reduction effect was obtained.

As understood from FIG. 14, in the relation between primary displacement ratio k1 and ΔVadh, ΔVadh was less than 50 [V] when primary displacement ratio k1 was in the range of $0 \leq k1 \leq 60$, thus confirming that substantially no adhesion force reduction effect was obtained. On the other hand, when primary displacement ratio k1 was in the range of $60 \leq k1$, ΔVadh tended to be increased to more than 50[V] as the value of primary displacement ratio k1 became larger, thus confirming that a high adhesion force reduction effect was obtained.

As understood from FIG. 15, in the relation between secondary displacement ratio k2 and ΔVadh, ΔVadh was less than 50[V] when secondary displacement ratio k2 was in the range of $0 \leq k2 \leq 6$, thus confirming that that substantially no adhesion force reduction effect was obtained. On the other hand, when secondary displacement ratio k2 was in the range of $6 \leq k2$, ΔVadh tended to be increased to more than 50 [V] as the value of secondary displacement ratio k2 became larger, thus confirming that a high adhesion force reduction effect was obtained.

The above results provide a ground for setting respective lower limit values of overshoot ratio E, primary displacement ratio k1, and secondary displacement ratio k2 in the above-described first to third conditions. The above results indicate that in addition to the deformation following effect, a sufficient adhesion force reduction effect is obtained when the condition of the lower limit value one of the first to third conditions is satisfied.

<Experiment for Checking Performance>

The present inventors manufactured a multiplicity of belts including elastic layers having different compositions by preparing various types and amounts of resins, additive agents, crosslinking agents and the like to be included in the elastic layers. These belts were evaluated based on the above-described belt evaluation method employing displacement amount measuring device 100 to determine overshoot ratio E, primary displacement ratio k1, and secondary displacement ratio k2 of each of the belts. Moreover, each of the belts was subjected to an experiment for checking performance of each belt under a predetermined condition.

In the experiment for checking performance, an image forming apparatus provided by Konica Minolta (digital multifunctional peripheral: bizhub PRESS C6000) was used. An intermediate transfer belt provided in this image forming apparatus was replaced with each of the above-described belts. The diameter and secondary transfer pressure of a secondary transfer roller were also changed or adjusted as required.

In the experiment for checking performance, quality of transferability to a recess of a sheet of embossed paper, presence/absence of image noise after printing 10,000 sheets, quality of uniformity of transfer in the axial direction of the secondary transfer roller, presence/absence of void were checked for each of experiment examples 1 to 18 for which at least either the types of belts or the image formation conditions are different from one another. It should be noted that the term "void" refers to a phenomenon of transfer failure occurring at the central portion of a formed image such as a thin line or halftone dot.

FIG. 16 is a table showing image formation conditions and image formation results in the experiment for checking performance. As shown in FIG. 16, a total of ten types of transfer belts, A to D, O, F to I, and X, including elastic layers having different compositions were prepared as the belts. The transfer pressure was set in a total of five levels between 70 [kPa] and 500 [kPa]. The diameter of the secondary transfer roller was set in a total of five levels between 16 [mm] and 70 [mm].

Here, each of the types of belts A to D, O and F-I was manufactured by the present inventors, had a base layer composed of polyimide, and had an elastic layer composed of a nitrile rubber. On the other hand, the type of belt X was not manufactured by the present inventors, was an intermediate transfer belt used in a commercially available image forming apparatus, had a base layer composed of polyimide, and had an elastic layer composed of a chloroprene rubber.

It should be noted that as a result of preliminarily performing image formation before the experiment for checking performance, it was confirmed that transferability to a recess of a sheet of embossed paper in the case where the hardness of the surface of the secondary transfer roller was higher than the hardness of the surface of the counter roller was more excellent than those in the case where the hardness of the surface of the secondary transfer roller was lower than the hardness of the surface of the counter roller and the case where the hardness of the surface of the counter roller was the same as the hardness of the surface of the secondary transfer roller.

This is due to the following reason. That is, when the hardness of the surface of secondary transfer roller 6 is higher than the hardness of the surface of counter roller 7, a recessively curved elongated surface is formed in first main surface 1*a* of transfer belt 1 as also shown in FIG. 2. A surface portion of the recessively curved elongated surface is a portion to be compressed and therefore has room for great deformation, thereby facilitating an action for promoting deformation of first main surface 1*a*.

(Quality of Transferability)

In order to check the quality of transferability, embossed paper with a product name "LEATHAC® 66" provided by Tokushu Tokai Paper Co., Ltd was used. Each sheet of embossed paper had a basis weight of 302 [g/m$^2$]. A solid image was formed thereon. For determination thereof, a microdensitometer was used to measure reflection density of a sharp and deep recess and reflection density of a protrusion, and a density difference therebetween was calculated. When the density difference was less than 0.25, it was determined as "Good" When the density difference was not less than 0.25 and less than 0.40, it was determined as "Applicable". When the density difference was not less than 0.40, it was determined as "Not Applicable".

(Presence/Absence of Image Noise)

The presence/absence of the image noise was checked by printing a solid image using the apparatus after printing 10,000 sheets and then observing image quality of the solid image. Also, the transfer belt was observed to check whether or not the transfer belt was cracked or worn after printing 10,000 sheets. For determination thereof, when the transfer belt was not cracked or worn and there was no noise in the image, it was determined as "Good". When the transfer belt was cracked and worn but there was no noise in the image, it was determined as "Applicable" When the transfer belt was cracked and worn and there was noise in the image, it was determined as "Not Applicable".

(Quality of Uniformity of Transfer in Axial Direction)

In order to check the quality of uniformity of transfer in the axial direction of the secondary transfer roller, coated paper was used. Each sheet of coated paper had a basis weight of 151 [g/m$^2$]. A solid image was formed thereon. For determination thereof, a microdensitometer was used to measure reflection densities at 20 random positions in the longitudinal direction of the sheet of coated paper, and a density difference between the maximum value and minimum value of the measured reflection densities was calculated. When the density difference was less than 0.10, it was determined as "Good". When the density difference was not less than 0.10 and less than 0.20, it was determined as "Applicable". When the density difference was not less than 0.20, it was determined as "Not Applicable".

(Presence/Absence of Void)

In order to check the presence/absence of void, coated paper was used. Each sheet of coated paper had a basis weight of 151 [g/m$^2$]. An image of five thin lines each having a length of 60 [mm] and a width of 3 dots was formed. The image was observed using a magnifier to check presence/absence of disturbance of the image. For determination thereof, when each thin line was not disturbed, it was determined as "Good". When the thin line was only slightly disturbed, it was determined as "Applicable". When the thin line was disturbed in an unacceptable manner, it was determined as "Not Acceptable".

(Comprehensive Evaluation)

In the comprehensive evaluation, one including the evaluation "Not Applicable" in one of the quality of transferability, the presence/absence of image noise, the quality of uniformity of transfer in the axial direction, and the presence/absence of void was determined as "Not Applicable". One not including the evaluation "Not Applicable" and including the evaluation "Applicable" in the quality of transferability, the presence/absence of image noise, the quality of uniformity of transfer in the axial direction, and the presence/absence of void was determined as "Good" or "Applicable". One including the evaluation "Good" in each of the quality of transferability, the presence/absence of image noise, the quality of uniformity of transfer in the axial direction, and the presence/absence of void was determined as "Excellent", It should be noted that a difference between "Good" and "Applicable" in the comprehensive evaluation is as follows: one including the evaluation "Good" in each of the quality of transferability and the presence/absence of image noise was determined as "Good", whereas one including the evaluation "Applicable" in at least one of the quality of transferability and the presence/absence of image noise was determined as "Applicable".

(Experimental Result)

As understood from FIG. 16, in each of experiment examples 1 to 13, 16, and 17 in which overshoot ratio E [−] satisfied $0.2 \leq E \leq 3$ (i.e., satisfied the first condition), the adhesion force reduction effect was greatly exhibited, excellent transferability was obtained also in the recess of the sheet of embossed paper, and excellent results were obtained also in terms of image quality and durability. On the other hand, in each of experiment examples 14 and 18 in which overshoot ratio E[−] satisfied $E<0.2$, the adhesion force reduction effect was not sufficiently exhibited, and excellent transferability was not obtained in the recess of the sheet of embossed paper. Moreover, in experiment example 15 in which overshoot ratio E [−] satisfied $3<E$, image noise occurred due to repeated use, thus resulting in problems in terms of image quality and durability.

The above results provide a ground for setting the upper limit value and lower limit value of overshoot ratio E in the first condition. When a transfer belt is configured to satisfy the first condition, high transferability to a recording medium having a surface provided with irregularity can be achieved and image quality can be suppressed from being deteriorated by repeated use.

Moreover, as understood from FIG. 16, in each of experiment examples 1 to 13, 16, and 17 in which primary displacement ratio k1 [μm/s] satisfied $60 \leq k1 \leq 320$ (i.e., satisfied the second condition), the adhesion force reduction effect was greatly exhibited, good transferability was obtained also in the recess of the sheet of embossed paper, and good results were obtained also in terms of image quality and durability. On the other hand, in each of experiment examples 14 and 18 in which primary displacement ratio k1 [μm/s] satisfied $k1<60$, the adhesion force reduction effect was not sufficiently exhibited, and good transferability was not obtained in the recess of the sheet of embossed paper. Moreover, in experiment example 15 in which primary displacement ratio k1 [μm/s] satisfied $320<k1$, image noise occurred due to repeated use, thus resulting in problems in terms of image quality and durability.

The above results provide a ground for setting the upper limit value and lower limit value of primary displacement ratio k1 in the second condition. When a transfer belt is configured to satisfy the second condition, high transferability to a recording medium having a surface provided with irregularity can be achieved and image quality can be suppressed from being deteriorated by repeated use.

Moreover, as understood from FIG. 16, in each of experiment examples 1 to 13, 16, and 17 in which secondary displacement ratio k2 [m/s] satisfied $6 \leq k2 \leq 30$ (i.e., satisfied the third condition), the adhesion force reduction effect was greatly exhibited, good transferability was obtained also in the recess of the sheet of embossed paper, and good results were obtained also in terms of image quality and durability. On the other hand, in each of experiment examples 14 and 18 in which secondary displacement ratio k2 [μm/s] satisfied $k2<6$, the adhesion force reduction effect is not sufficiently exhibited, and good transferability was not obtained in the recess of the sheet of embossed paper. Moreover, in experiment example 15 in which secondary displacement ratio k2 [μm/s] satisfied $30 \leq k2$, image noise occurred due to repeated use, thus resulting in problems in terms of image quality and durability.

The above results provide a ground for setting the upper limit value and lower limit value of secondary displacement ratio k2 in the third condition. When a transfer belt is configured to satisfy the third condition, high transferability to a recording medium having a surface provided with irregularity can be achieved and image quality can be suppressed from being deteriorated by repeated use.

Further, as understood from FIG. 16, in experiment examples 1 to 13 in each of which one of the first to third conditions was satisfied and convergence value b [μm] satisfied $4 \leq b \leq 8$ (i.e., satisfied the fourth condition), the adhesion force reduction effect was greatly exhibited, very good transferability was obtained also in the recess of the sheet of embossed paper, and very good results were obtained also in terms of image quality and durability.

In addition, as understood from FIG. 16, in each of experiment examples 1 to 11, 16, and 17 in which one of the first to third conditions was satisfied and the diameter of the secondary transfer roller was not less than 20 [mm] and not more than 60 [mm], good transferability was obtained also in the recess of the sheet of embossed paper, wear resistance was also good, and the density difference in the axial direction and the void were also in acceptable levels. On the other hand, in experiment example 12 in which the diameter of the secondary transfer roller was less than 20 [mm], a slight density difference was caused in the axial direction due to bending of the secondary transfer roller. Moreover, in experiment example 13 in which the diameter of the secondary transfer roller was more than 60 [mm], void occurred and thin line reproducibility was deteriorate slightly.

Thus, when one of the first to third conditions is satisfied and the diameter of the secondary transfer roller is not less than 20 [mm] and not more than 60 [mm], an image having higher quality can be formed.

In addition, as understood from FIG. 16, in each of experiment examples 1 to 9, 12, 13, 16, and 17 in which one of the first to third conditions was satisfied and the maximum pressure in the nip portion of the secondary transfer portion was not less than 100 [kPa] and not more than 400 [kPa], good transferability was obtained also in the recess of the sheet of embossed paper, wear resistance was also good, and the density difference in the axial direction and the void were also in the acceptable levels. On the other hand, in experiment example 10 in which the maximum pressure in the nip portion of the secondary transfer portion was less than 100 [kPa], transfer pressure became unstable to result in a slight density difference in the axial direction. Meanwhile, in experiment example 11 in which the maximum pressure in the nip portion of the secondary transfer portion was more than 400 [kPa], the transfer pressure was too high, with the result that the void occurred and the thin line reproducibility was deteriorated slightly.

Therefore, when one of the first to third conditions is satisfied and the maximum pressure in the nip portion of the secondary transfer portion is set at not less than 100 [kPa] and not more than 400 [kPa], an image having higher quality can be formed.

<Additional Experiment>

The present inventors conducted a below-described additional experiment and confirmed that the following effects can be obtained as secondary effects according to the present invention: an effect of improving detachability of the recording medium from the transfer belt after the transfer; and an effect of improving cleanability for the transfer belt.

For the additional experiment, the present inventors manufactured a multiplicity of belts including elastic layers having different compositions by preparing various types and amounts of resins, additive agents, crosslinking agents and the like to be included in the elastic layers. These belts were evaluated based on the belt evaluation method employing displacement amount measuring device 100 to determine secondary displacement ratio k2 of each belt. A plurality of belts having different secondary displacement ratios k2 were selected.

As with the experiment for checking performance, in the additional experiment, an image forming apparatus provided by Konica Minolta (digital multifunctional peripheral: bizhub PRESS C6000) was used and an intermediate transfer belt provided in this image forming apparatus was sequentially replaced with the above-described plurality of belts, so as to check the detachability of recording medium and the cleanability.

FIG. 17 is a table showing image formation conditions and image formation results in the additional experiment. As shown in FIG. 17, for the types of belts, a total of five types of transfer belts, J to N, including elastic layers having different compositions were prepared. Transfer pressure was set at 200 [kPa] in each case. The diameter of the secondary transfer roller was set at 40 [mm] in each case.

Here, each of the types of belts J to N was manufactured by the present inventors, and had a base layer composed of polyimide and had an elastic layer composed of a nitrite rubber.

(Quality of Detachability of Recording Medium)

In order to check the quality of detachability of the recording medium, regular paper with a product name "J paper" provided by Konica Minolta was used. Each sheet of regular paper had a basis weight of 64 [g/m$^2$]. Images having different densities were formed. 1000 sheets of the regular paper were printed. The quality of detachability of the recording medium was determined based on the number of times of paper jams resulting from failure in detaching the sheets of regular paper in the secondary transfer portion during the printing. When no paper jam occurred, it was determined as "Good". When the number of times of paper jams was not less than once and not more than three times, it was determined as "Applicable". When the number of times of paper jams was not less than four times, it was determined as "Not Applicable".

(Quality of Cleanability)

In order to check the quality of cleanability, embossed paper with a product name "LEATHAC® 66" provided by Tokushu Tokai Paper Co., Ltd was used. Each sheet of embossed paper had a basis weight of 302 [g/m$^2$]. The quality of cleanability was determined by observing whether or not a formed image had image noise resulting from remnants on the cleaning blade of the cleaning portion. When there is not such image noise, it is determined as "Good". When there is such image noise in an acceptable level, it is determined as "Applicable". When there is such image noise in an unacceptable level, it is determined as "Not Applicable".

(Experimental Result)

As apparent from the experimental results of experiment examples 19 to 23 shown in FIG. 17, the detachability of the recording medium was better when using a transfer belt having a larger secondary displacement ratio k2 [μm/s]. When transferring a toner image to a sheet of non-embossed paper, the surface of the transfer belt is deformed to completely follow the irregularity of the recording medium because a level difference between recess and protrusion therein is small, thus resulting in a large contact area between the surface of the transfer belt and the surface of the recording medium. Accordingly, the detachability is likely to be decreased. However, when a transfer belt having a large secondary displacement ratio k2 [μm/s] is used, the surface of the transfer belt is deformed to completely follow the irregularity of the recording medium in the central portion of the nip portion in which the transfer pressure is the maximum but the surface of the transfer belt is reverted from the deformation near the outlet of the nip portion, thus resulting in a small contact area between the surface of the transfer belt and the surface of the recording medium. Accordingly, the recording medium is readily detached from the transfer belt. On the other hand, when a transfer belt having a small secondary displacement ratio k2 [μm/s] is used, the surface of the transfer belt is deformed to completely tbllow the irregularity of the recording medium in the central portion of the nip portion and is then insufficiently reverted from the deformation even near the outlet of the nip portion, with the result that the contact area between the surface of the transfer belt and the surface of the recording medium is still large. Accordingly, the recording medium is less likely to be detached from the transfer belt.

Moreover, as apparent from the experimental results of experiment examples 19 to 23 shown in FIG. 17, when a transfer belt having a small secondary displacement ratio k2 [μm/s] is used, the cleanability is deteriorated. This is due to the following reason. That is, even when the transfer belt reaches the cleaning portion after the transfer belt is deformed to follow the level difference between the recess and protrusion of the sheet of paper in the secondary transfer portion, the surface of the transfer belt is not reverted from the deformation and the surface of the transfer belt therefore has irregularity, with the result that part of residual toner is avoided from the cleaning belt to cause cleaning failure. On the other hand, in the case where a transfer belt having a large secondary displacement ratio k2 [μm/s] is used, when the transfer belt reaches the cleaning portion after the transfer belt is deformed to follow the level difference between the recess and protrusion of the sheet of paper in the secondary transfer portion, the transfer belt has been already reverted from the deformation, with the result that the surface of the transfer belt becomes smooth. Accordingly, cleaning failure is unlikely to occur.

<Image Forming Apparatus>

Figure 18:
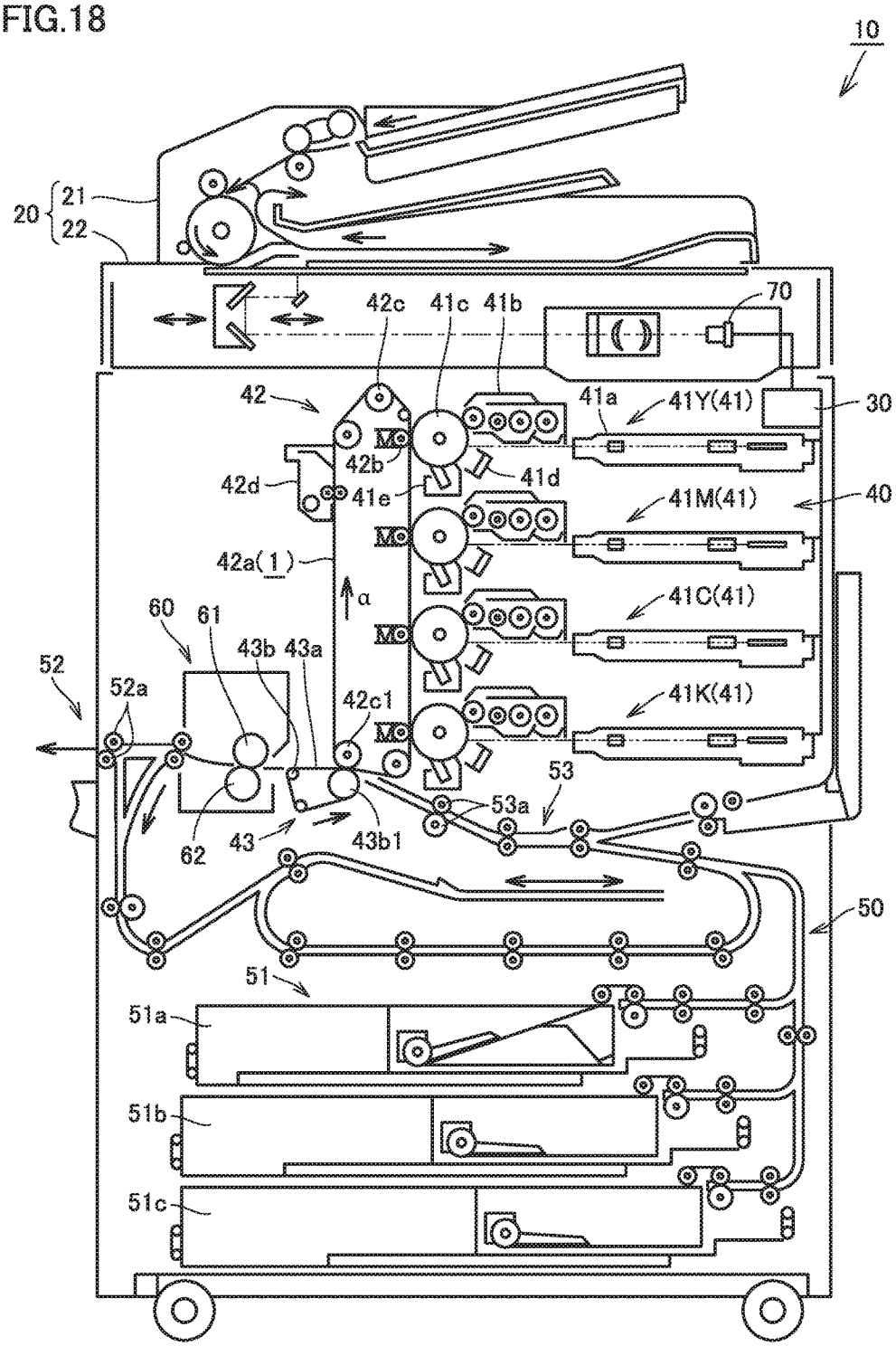
FIG. 18 is a schematic view of an image forming apparatus in the embodiment of the present invention.

FIG. 18 is a schematic view of an image forming apparatus in the present embodiment. With reference to FIG. 18, the following describes an image forming apparatus 10 in the present embodiment. It should be noted that image forming apparatus 10 shown in FIG. 18 is a digital multi-functional peripheral.

Image forming apparatus 10 in the present embodiment includes transfer belt 1 in the present embodiment as an intermediate transfer belt 42*a*. Transfer belt 1 is used in basically the same manner as that in the exemplary usage already described using FIG. 2.

As shown in FIG. 18, image forming apparatus 10 includes an image scanning unit 20, an image processing unit 30, an image forming unit 40, a sheet conveying unit 50, and a fixing device 60.

Image forming unit 40 has image forming units 41 (41Y, 41M, 41C, 41K) for forming an image using color toners of Y (yellow), M (magenta), C (cyan), and K (black). Since these image forming units 41 have the same configuration apart from the toner stored therein, signs representing the colors will be omitted below. Image forming unit 40 further includes an intermediate transfer unit 42 and a secondary transfer unit 43.

Image forming unit 41 has an exposing device 41*a*, a developing device 41*b*, a photoconductor drum 41*c*, a charging device 41*d*, and a drum cleaning device 41*e*. Photoconductor drum 41*c* has a surface having photoconductivity, and is a negative charge type organic photoconductor, for example. Photoconductor drum 41*c* is an image carrier that carries a toner image.

Charging device 41*d* is, for example, a corona charger, but may be a contact charging device for charging photoconductor drum 41*c* by bringing a contact charging member such as a charging roller, a charging brush, or a charging blade into contact with photoconductor dram 41*c*. Exposing device 41*a* is constituted of a semiconductor laser, for example.

Developing device 41*b* is, for example, a double-component development type developing device; however, developing device 41*b* may be a single-component development type developing device with no carrier.

Intermediate transfer unit 42 includes: an intermediate transfer belt 42*a* constituted of transfer belt 1 in the present embodiment; a primary transfer roller 42*b* for pressing intermediate transfer belt 42*a* into contact with photoconductor drum 41*c*; a plurality of supporting rollers 42*c* including a counter roller 42*c*1; and a belt cleaning device 42*d*. Intermediate transfer belt 42*a* is an endless transfer belt. Here, a primary transfer portion is mainly constituted of primary transfer roller 42*b*.

Intermediate transfer belt 42*a* is suspended in the form of a loop on the plurality of supporting rollers 42*c*, and is movable. When at least one drive roller of the plurality of supporting rollers 42*c* is rotated, intermediate transfer belt 42*a* travels at a constant speed in a direction of arrow α.

Secondary transfer unit 43 includes an endless secondary transfer belt 43*a*; and a plurality of supporting rollers 43*b* including a secondary transfer roller 43*b*1. Secondary transfer belt 43*a* is suspended in the form of a loop on secondary transfer roller 43*b*1 and supporting rollers 43*b*. Here, a secondary transfer portion is mainly constituted of secondary transfer roller 43*b*1 and counter roller 42*c*1.

Fixing device 60 includes: a fixing roller 61 that heats and melts toner on a sheet serving as a recording medium; and a pressure applying roller 62 that presses the sheet onto fixing roller 61.

Image scanning unit 20 has an automatic document feeder 21 and a document image scanning device 22 (scanner). Of these, document image scanning device 22 is provided with a contact glass, various types of lens systems, and a CCD sensor 70. Moreover, CCD sensor 70 is connected to image processing unit 30.

Sheet conveying unit 50 has a sheet supplying unit 51, a sheet ejecting unit 52, and a conveyance path unit 53. Sheet supply tray units 51*a* to 51*c* included in sheet supplying unit 51 store, in accordance with predetermined types, sheets (sheets of standard paper and sheets of special paper) identified based on basis weight, size, or the like. Conveyance path unit 53 has a plurality of conveying roller pairs, such as a resist roller pair 53*a*. Sheet ejecting unit 52 is constituted of a sheet ejecting roller 52*a*.

Next, the following describes a process of image formation by image forming apparatus 10. Document image scanning device 22 optically scans and reads a document on the contact glass. Reflected light from the document is read by CCD sensor 70, and becomes input image data. The input image data is subjected to a predetermined image process in image processing unit 30, and is then sent to exposing device 41*a*. It should be noted that the input image data may be sent from an external personal computer, a mobile device, or the like to image forming apparatus 10.

Photoconductor drum 41*c* is rotated at a certain circumferential speed. Charging device 41*d* negatively charges the surface of photoconductor drum 41*c* uniformly. Exposing device 41*a* irradiates photoconductor drum 41*c* with laser light corresponding to the input image data of each color component, thereby forming an electrostatic latent image on the surface of photoconductor drum 41*c*. Developing device 41*b* adheres toner to the surface of photoconductor drum 41*c* to visualize the electrostatic latent image on photoconductor drum 41*c*. In this way, a toner image corresponding to the electrostatic latent image is formed on the surface of photoconductor drum 41*c*.

The toner image on the surface of photoconductor drum 41*c* is transferred to intermediate transfer belt 42*a* by intermediate transfer unit 42. Remaining non-transferred toner on the surface of photoconductor drum 41*c* after the transfer is removed by drum cleaning device 41*e* having a drum cleaning blade that is slidably in contact with the surface of photoconductor drum 41*c*. Intermediate transfer belt 42*a* is pressed into contact with photoconductor drum 41*c* by primary transfer roller 42*b*, whereby the respective toner images of the colors are sequentially transferred to overlap with one another on intermediate transfer belt 42*a*.

Secondary transfer roller 43*b*1 is pressed into contact with counter roller 42*c*1 with intermediate transfer belt 42*a* and secondary transfer belt 43*a* being interposed therebetween. Accordingly, a transfer nip is formed. A sheet is conveyed to the transfer nip by sheet conveying unit 50 and passes through this transfer nip. Inclination of the sheet is corrected and a timing of conveyance thereof is adjusted by a resist roller portion provided with resist roller pair 53*a*.

When a sheet is conveyed to the transfer nip, transfer bias is applied to secondary transfer roller 43*b*1. Due to the application of transfer bias, the toner image carried by intermediate transfer belt 42*a* is transferred to the sheet. Remaining non-transferred toner on the surface of intermediate transfer belt 42*a* is removed by belt cleaning device 42*d* having the belt cleaning blade that is slidably in contact with the surface of intermediate transfer belt 12*a*. Belt cleaning device 42*d* may employ a cleaning method using a brush as long as belt cleaning device 42*d* is configured to clean residual toner on intermediate transfer belt 42*a*. Moreover, when toner having a high transfer ratio is used, no cleaning device may be used. The sheet having the toner image transferred thereon is conveyed to fixing device 60 by secondary transfer belt 43*a*.

Fixing device 60 heats and presses, at the nip portion, the conveyed sheet having the toner image transferred thereon. In this way, the toner image is fixed to the sheet. The sheet having the toner image fixed thereon is ejected out of the apparatus by sheet ejecting unit 52 including sheet ejecting roller 52*a*.

Here, the toner has a binder resin in which a coloring agent, and, if necessary, a charge control agent, a parting agent, or the like are contained to treat an external additive agent. Generally used, known toner can be used therefor. The toner preferably has particles having a volume average particle size falling within a range of not less than 2 [μm] and not more than 12 [μm], and has more preferably particles having a volume average particle size falling within a range of not less than 3 [μm] and not more than 9 [μm] in view of image quality.

The toner preferably has a shape factor SF-1 of, but not limited to, 100 to 140.

Shape factor SF-1 is determined from an average value of shape factors by using a scanner to randomly scan 100 images of the toner captured by a scanning electron microscope at ×5000 and then analyzing them using an image processing analysis device "LUZCX AP" (provided by Nireco). The average value of the shape factors (SF-1) is determined based on the following formula:

$$SF\text{-}1-[\{(\text{absolute maximum length of particles})^2/(\text{projected area of particles})\}\times(\pi/4)]\times 100.$$

For the external additive agent of the toner, fine particles of metal oxide such as silica or titania are used. The fine particles used herein has a small particle size of 30 [nm] or has a relatively large particle size of 100 [nm]. For powder flowability and charge control, inorganic particles having a primary average particle size of not more than 40 [nm] may be used. Further, inorganic or organic fine particles having a larger size may be used together as required to reduce adhesion force. Examples of the inorganic particles include: silica, titania, alumina, metatitanic acid, zinc oxide, zirconia, magnesia, calcium carbonate, magnesium carbonate, calcium phosphate, cerium oxide, strontium titanate, and the like. Moreover, in order to improve dispersibility and powder flowability, the surfaces of the inorganic particles may be treated additionally.

The carrier is not particularly limited and a generally used, known carrier can be used, such as a binder type carrier or a coat type carrier. A carrier particle size is preferably, but not limited to, not less than 15 [μm] and not more than 100 [μm].

In the present embodiment above, it has been described that the present invention is applied to the digital multifunctional peripheral serving as the image forming apparatus and is applied to the intermediate transfer belt included therein as the transfer belt; however, the present invention can be also applied to a different image forming apparatus and a transfer belt included therein.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A transfer belt at least comprising an elastic layer, the transfer belt having a pair of exposed main surfaces constituted of a first main surface and a second main surface located opposite to each other, the transfer belt being for transferring a toner image carried on the first main surface to a recording medium, k2 [μm/s] satisfying $6 \le k2 \le 30$ when a pressed region of the transfer belt is pressed at a pressure application rate of 4 [kPa/ms] until pressure application force reaches 200 [kPa] and then is uniformly pressed under the pressure application force of 200 [kPa] by using a lower block that has an upper surface having a protrusively curved elongated surface having a width of 20 [mm] and a curvature radius of 20 [mm] and that is provided with a hole formed at a top of the protrusively curved elongated surface and having a diameter of 1.25 [mm] and an upper block that has a lower surface having a recessively curved elongated surface having a width of 20 [mm] and a curvature radius of 20.3 [mm] so as to place the transfer belt on the upper surface of the lower block such that the first main surface faces the upper surface of the lower block and so as to sandwich a portion of the transfer belt between the protrusively curved elongated surface and the recessively curved elongated surface by lowering the upper block toward the lower block, the pressed region of the transfer belt being the portion of the transfer belt sandwiched between the protrusively curved elongated surface and the recessively curved elongated surface, k2 [μm/s] being determined by $(a-b)/\{2\times(t2-t1)\}$, where a [μm] represents a maximum value of a displacement amount of a measurement region that is a portion of the first main surface corresponding to the hole, b [μm] represents the displacement amount of the measurement region after the displacement of the measurement region is converged, t1 [s] represents a period of time from a point of time at which the pressed region is started to be pressed to a point of time at which the maximum value of the displacement amount of the measurement region is observed, and t2 [s] represents a period of time from the point of time at which the pressed region is started to be pressed to a point of time at which the displacement amount of the measurement region reaches $(a+b)/2$ again after the maximum value of the displacement amount of the measurement region is observed.

2. The transfer belt according to claim 1, wherein b further satisfies $4 \leq b \leq 8$.

3. The transfer belt according to claim 1, further comprising a base layer and a front layer in addition to the elastic layer, wherein the first main surface is defined by the front layer by providing the elastic layer to cover the base layer and providing the front layer to cover the elastic layer.

4. An image forming apparatus comprising:

an image carrier and an intermediate transfer belt that both carry a toner image;

a primary transfer portion that transfers the toner image carried by the image carrier to the intermediate transfer belt; and a secondary transfer portion that transfers the toner image carried by the intermediate transfer belt to a recording medium, the secondary transfer portion including a secondary transfer roller, a counter roller facing the secondary transfer roller, and a nip portion formed by the secondary transfer roller and the counter roller, the intermediate transfer belt being disposed to pass through the nip portion, the transfer belt recited in claim 1 being used as the intermediate transfer belt.

5. The image forming apparatus according to claim 4, wherein the first main surface of the intermediate transfer belt is disposed to face the secondary transfer roller, and the secondary transfer roller has a surface having a hardness higher than a hardness of a surface of the counter roller.

6. The image forming apparatus according to claim 4, wherein the secondary transfer roller has a diameter of not less than 20 [mm] and not more than 60 [mm].

7. The image forming apparatus according to claim 4, wherein a maximum pressure in the nip portion is not less than 100 [kPa] and not more than 400 [kPa].

* * * * *